US007164871B2

(12) United States Patent
Inoue

(10) Patent No.: US 7,164,871 B2
(45) Date of Patent: Jan. 16, 2007

(54) IMAGE FORMING APPARATUS

(75) Inventor: Hiroyuki Inoue, Tokyo (JP)

(73) Assignee: Oki Data Corporation, Tokyo (JP)

( * ) Notice: Subject to any disclaimer, the term of this patent is extended or adjusted under 35 U.S.C. 154(b) by 155 days.

(21) Appl. No.: 11/052,760

(22) Filed: Feb. 9, 2005

(65) Prior Publication Data

US 2005/0180768 A1 Aug. 18, 2005

(30) Foreign Application Priority Data

Feb. 13, 2004 (JP) ..... 2004-036592

(51) Int. Cl.
*G03G 15/20* (2006.01)

(52) U.S. Cl. ..... 399/69

(58) Field of Classification Search ..... 399/69, 399/322, 22; 219/216
See application file for complete search history.

(56) References Cited

U.S. PATENT DOCUMENTS 4,952,781 A * 8/1990 Kozaiku
5,940,655 A * 8/1999 Sano et al. ..... 399/69

FOREIGN PATENT DOCUMENTS

JP 11-084940 3/1999
JP 2001092303 A * 4/2001

* cited by examiner

*Primary Examiner*—Susan Lee
(74) *Attorney, Agent, or Firm*—Rabin & Berdo, PC

(57) ABSTRACT

An image forming apparatus has a fixing unit that fixes a developer transferred onto a print medium. The apparatus includes a temperature detector and a movement detector. The temperature detector has a thermistor that detects a temperature of or near a fixing member. The movement detector detects that the thermistor has moved relative to the fixing member. The movement detector includes a first, second, and third electrically conductive members. The first electrically conductive member and a second electrically conductive member are connected to each other via the thermistor. The third electrically conductive member cooperates with the first electrically conductive member to form a first switch, and with the second electrically conductive member to form a second switch. When the thermistor moves out of contact engagement with the fixing member, at least one of the first switch and the second switch is closed.

19 Claims, 22 Drawing Sheets

IMAGE FORMING APPARATUS

FIELD OF THE INVENTION

The present invention generally relates to an image forming apparatus and more particularly to an improvement of safety of a fixing unit.

DESCRIPTION OF RELATED ART

A conventional color electrophotographic printer incorporates yellow, magenta, cyan, and black image-forming sections aligned in a line. FIG. 38 shows one such electrophotographic printer. Respective image-forming sections include recording heads 3Y, 3M, 3C, and 3B in which point light sources as a recording element are aligned in a line and energized in accordance with print data to form electrostatic latent images of corresponding colors. Toner tanks 12Y, 12M, 12C, and 12B supply yellow, magenta, cyan, and black toners to the electrostatic latent images to form toner images of corresponding colors. A paper cassette 41 feeds a recording medium S on a page-by-page basis. Each page of recording medium S is attracted to a transfer belt 20 and transported through the image-forming sections in a direction substantially perpendicular to a direction in which the recording elements are aligned. When the recording medium passes through the respective image forming sections, the yellow, magenta, cyan, and black images are transferred onto the recording medium one over the other in registration.

Thereafter, the recording medium S passes through a fixing unit 63. The fixing unit 63 includes a fixing roller 64 having a heater therein and a resilient pressure roller 65 in pressure engagement with the fixing roller 64. When the recording medium S passes through a nip formed between the fixing roller 64 and the pressure roller 65, the toner images on the recording medium S are fused into a permanent color image. The temperature of the fixing unit 63 is controlled in accordance with temperatures detected by a thermistor 700 in pressure contact with the fixing roller 64 and a thermistor 701 in pressure contact with the pressure roller 65. FIG. 39 is an enlarged view of the conventional fixing unit 63. A support member 700*a* has one end to which the thermistor 700 is mounted and another end secured to a permanent portion of a chassis of the fixing unit 63. A support member 701*a* has one end to which the thermistor 701 is mounted and another end secured to a permanent portion of a chassis of the fixing unit 63.

FIG. 40 illustrates a circuit that detects the surface temperature of the fixing roller 64. Voltage-dividing resistors 72 and 73 cooperate with the thermistor 700 to divide a 5-V supply voltage by appropriate proportions. The resistance of the thermistor 700 follows the change in the surface temperature of the fixing roller 64, so that the voltage across the resistor 73 changes. An A/D converter 69 of a controller reads the change in the voltage across the resistor 73 to detect the surface temperature of the fixing roller 64. A similar circuit that incorporates the thermistor 701 detects the surface temperature of the pressure roller 65.

FIG. 41 illustrates another conventional fixing unit 63 of the belt type. A description will be given of only a portion different from that in FIG. 39. Pressure rollers 95 and 65 are oppositely disposed. A fixing belt 97 entrained about a heat roller 96 having a heater element therein and a pressure roller 95. The pressure roller 95 is in pressure contact with the pressure roller 65 with the fixing belt 97 sandwiched therebetween.

However, with the conventional image-forming apparatus that incorporates the aforementioned fixing unit, printing is performed assuming that the detected temperatures are within the normal range unless an abnormal condition is detected, for example, the temperatures of the fixing roller, fixing belt and pressure roller detected by the corresponding thermistor elements become constant or slowly deviates from the normal value monotonically due to shorting or opening of the circuit. If opening or shorting of the circuit is detected shortly after a printing operation has initiated, the fixing unit may be prevented from being overheated. If a contact type thermistor (FIG. 1B) is not in pressure contact with, for example, the fixing roller, fixing belt, and pressure roller or if a non-contact type thermistor (FIG. 1A) is away from, for example, the fixing roller, fixing belt, and pressure roller by more than a predetermined distance, the detected temperature is not accurate and temperature control is performed in accordance with the detected temperature with a large error. The erroneously detected temperature is lower than an actual temperature, causing the fixing unit to be overheated.

SUMMARY OF THE INVENTION

An object of the invention is to detect paper jam quickly and prevent overheat of a fixing unit.

An image forming apparatus has a fixing unit that fixes a developer transferred onto a print medium. The apparatus includes:

a temperature detector having a temperature detecting element that detects a temperature of a fixing member; and a movement detector that detects that the temperature detecting element has moved relative to the fixing member.

The fixing member is a fixing roller.

The fixing roller is a heat roller that is heated by a heat source.

The fixing roller is a pressure roller that is in pressure contact with the heat roller.

The fixing member is a fixing belt.

The fixing belt is a heating belt that is heated by a heat source.

The movement detector includes a first electrically conductive member and a second electrically conductive member connected to each other via the temperature detecting element and a third electrically conductive member disposed in the vicinity of the temperature detecting element. When the temperature detecting element moves, either the first electrically conductive member or the second electrically conductive member establishes electrical continuity with the third electrically conductive member.

The movement detector includes a first electrically conductive member mounted to the temperature detecting element, a second electrically conductive member disposed in the vicinity of the temperature detecting element. When the temperature detecting element moves, the first electrically conductive member and the second electrically conductive member establish electrical continuity with each other.

The movement detector includes a first electrically conductive member and a second electrically conductive member connected to each other via the temperature detecting element. When the temperature detecting element moves, the first electrically conductive member and the second electrically conductive member establish electrical continuity with each other.

The first electrically conductive member has a first end and a second end and the second electrically conductive member has a third end and a fourth end. The first electrically conductive member and the second electrically conductive member are electrically connected to the temperature detecting element through the first end and third end, the second end and the fourth end being connected to a stationary portion of the image forming apparatus.

The movement detector includes a first electrically conductive member and a second electrically conductive member connected to each other via the temperature detecting element, and a third electrically conductive member disposed in proximity to the temperature detecting element. When the movement detector moves, the first electrically conductive member and the second electrically conductive member establish electrically continuity through the third electrically conductive member.

The first electrically conductive member has a projection in proximity to the second electrically conductive member. When the temperature detecting element moves, the projection establishes electrical continuity with the second electrically conductive member.

The temperature detecting element outputs an electrical signal indicative of the temperature of the fixing member, and said temperature detector includes an electrical signal detecting section that detects the electrical signal. The movement detector determines based on the electrical signal detected by the electrical signal detecting section that the temperature detecting element has moved.

The movement detector includes an electrical switch disposed in proximity to the temperature detecting element. When the temperature detecting element moves, the switch either opens or closes.

The temperature detecting element is mounted to a resilient member.

The temperature detecting element is disposed in contact with the fixing member and said movement detector detects that the temperature detecting element has moved out of contact with the fixing member.

The temperature detecting element is disposed in proximity to the fixing member, and the movement detector detects that the temperature detecting element has moved relative to the fixing member.

The movement detector includes a first electrically conductive member, a second electrically conductive member connected to each other via the temperature detecting element, and a third electrically conductive member. When no paper jam occurs, the first electrically conductive member remains in electrical contact with the third electrically conductive member. When paper jam occurs, the first electrically conductive member moves out of contact with the third electrically conductive member.

An image forming apparatus includes a fixing member, a temperature detector, and a movement detector. The fixing member heats a developer transferred onto a print medium to fix the developer. The temperature detector has a temperature detecting element detects a temperature of a fixing member. The movement detector detects a position of the temperature detecting element.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

Figure 38:
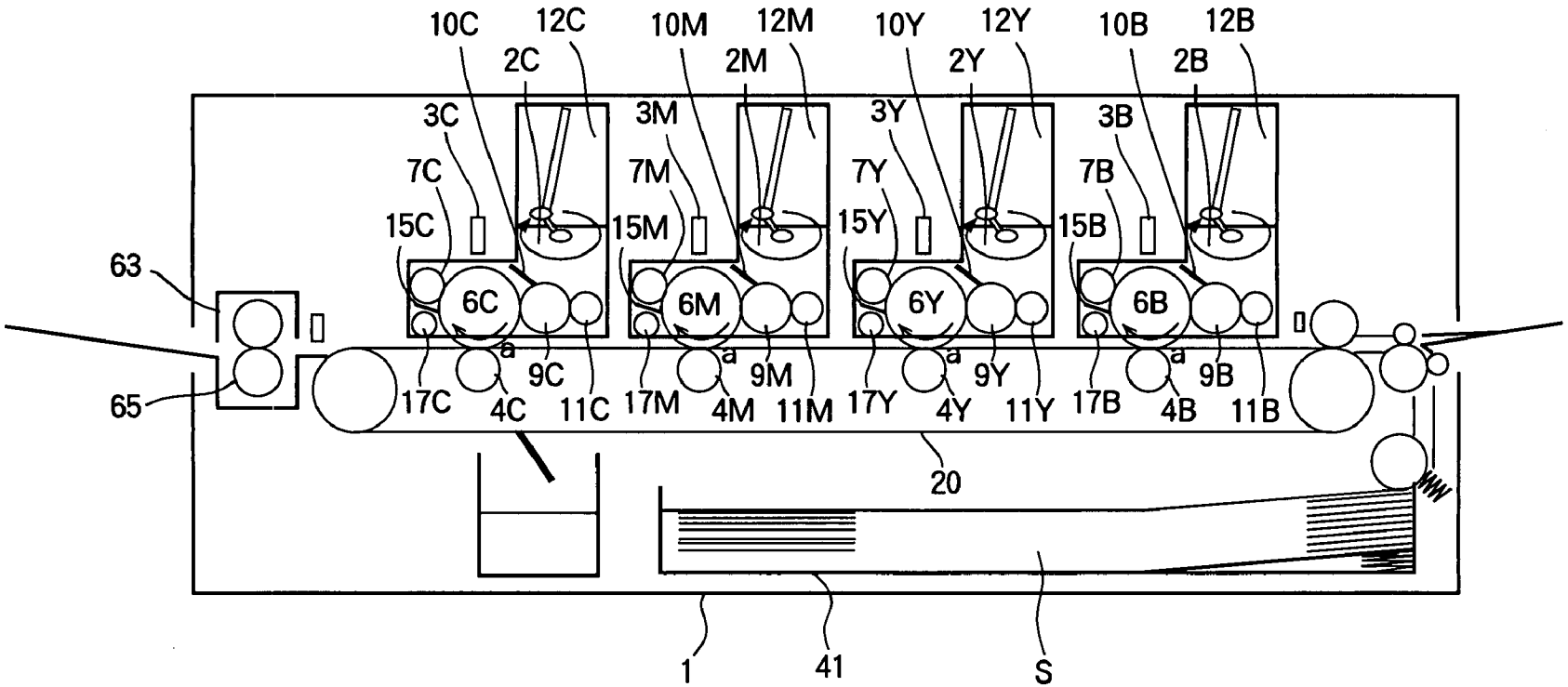
FIG.38 CONVENTIONAL ART
FIG. 38 shows a conventional electrophotographic printer.
Figure 39:
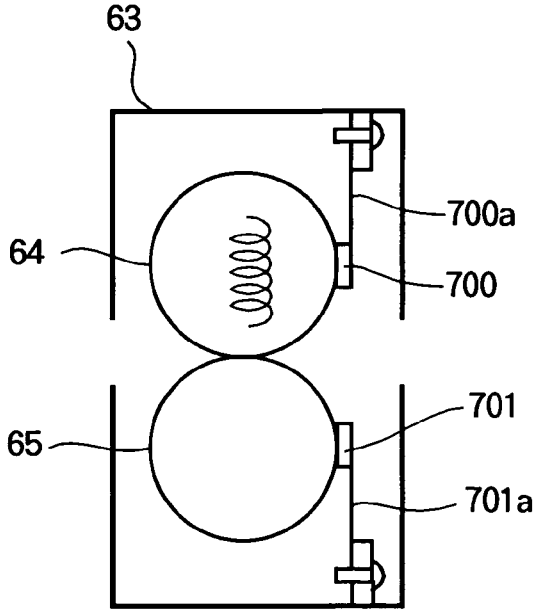
FIG.39 CONVENTIONAL ART
FIG. 39 is an enlarged view of the conventional fixing unit.
Figure 40:
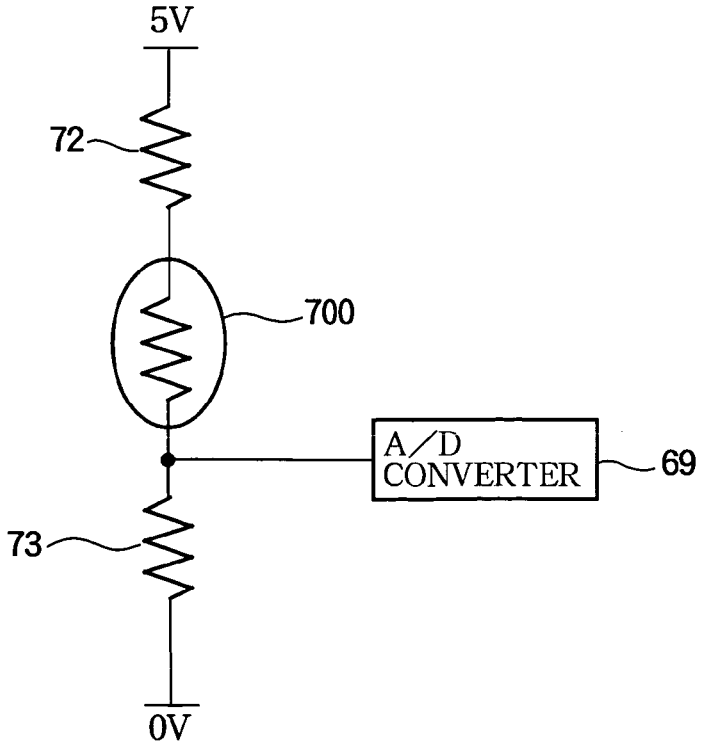
FIG.40 CONVENTIONAL ART
FIG. 40 illustrates a circuit that detects the surface temperature of a fixing roller of the conventional fixing unit.
Figure 41:
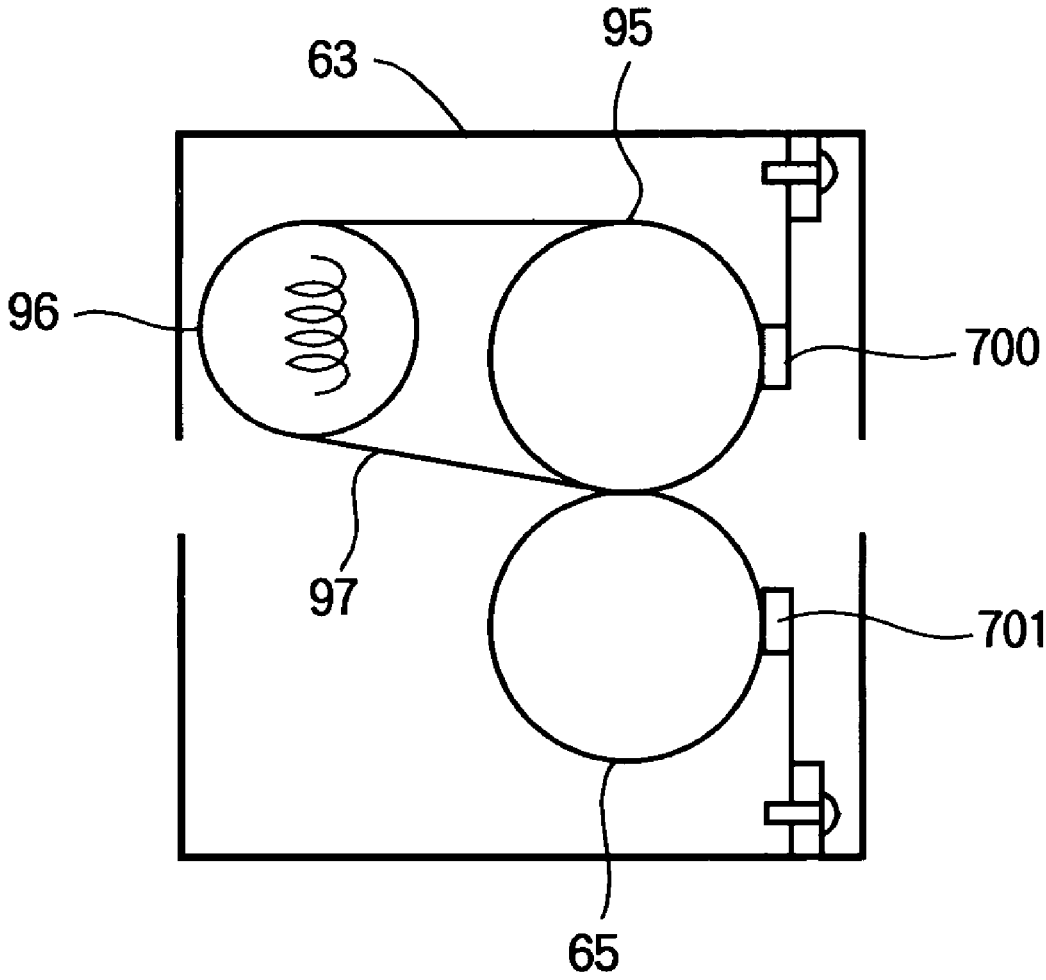
FIG.41 CONVENTIONAL ART
FIG. 41 illustrates another conventional fixing unit of the belt type.

A fixing unit 63 in first to ninth embodiments is of the same configuration as the fixing unit 63 in FIG. 38, and is detachably mounted. The fixing unit 63 is a consumable item that can be replaced by a user. That is, when the accumulated number of printed pages exceeds a predetermined value, the user is prompted to replace the fixing unit 63 for a new, unused one.

Figure 1A:
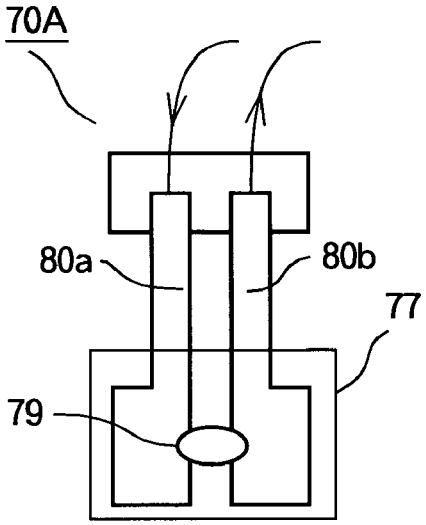
FIG. 1A illustrates a contact type thermistor.
Figure 1B:
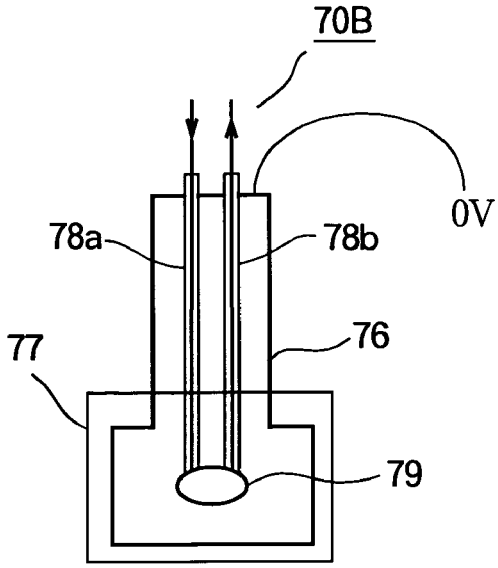
FIG. 1B illustrates a non-contact thermistor.

FIG. 1A and FIG. 1B illustrate a contact type thermistor and a non-contact thermistor, respectively. Two types of thermistor can be used in the first embodiment. The first is a contact type (FIG. 1A) where signal lines connected to a temperature-sensing element 79 are electrically continuous with base plates 80*a* and 80*b* that support the temperature-sensing element 79. The base plate 80*a* and 80 are made of a resilient material. The second is a non-contact type where signal lines connected to a temperature-sensing element 79 are electrically isolated from a base plate 76 that supports the temperature-sensing element 79. The base plate 76 is made of a resilient material. Here, by way of the contact type thermistor 70A, a description will be given of an example where the surface temperature of a fixing roller 64 that serves as a heat roller is detected. For this type of thermistor, the electrically conductive base plates 80*a* and 80*b* are used as both signal lines and reinforcing or supporting plates. A protection sheet 77 is formed of an insulating material to protect the temperature-sensing element 79.

Figure 2:
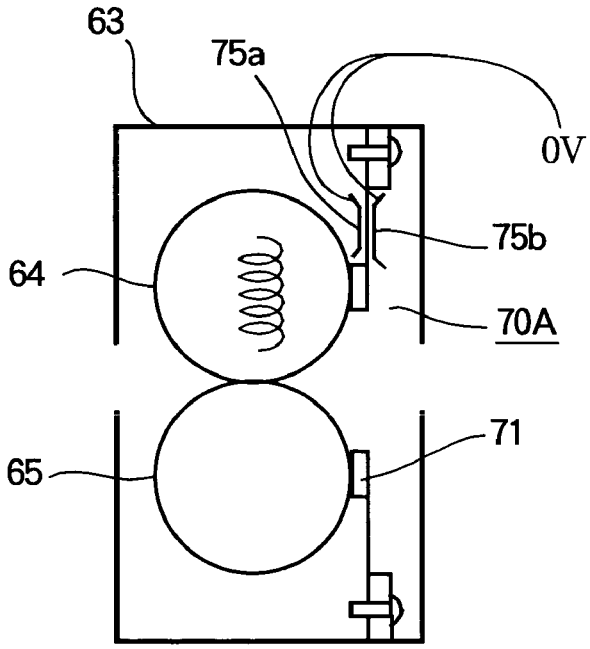
FIG. 2 illustrates the configuration of a first embodiment.

FIG. 2 illustrates the configuration of the first embodiment. This configuration differs from the conventional art in that the base plates 80*a* and 80*b* that support the temperature-sensing element 79 are positioned midway between closely disposed conductors 75*a* and 75*b*. When the conductors 75*a* and 75*b* are connected to 0 V and no paper jam has occurred, the base plates 80*a* and 80*b* are not in contact with any one of the conductors 75*a* and 75*b*.

Figure 3:
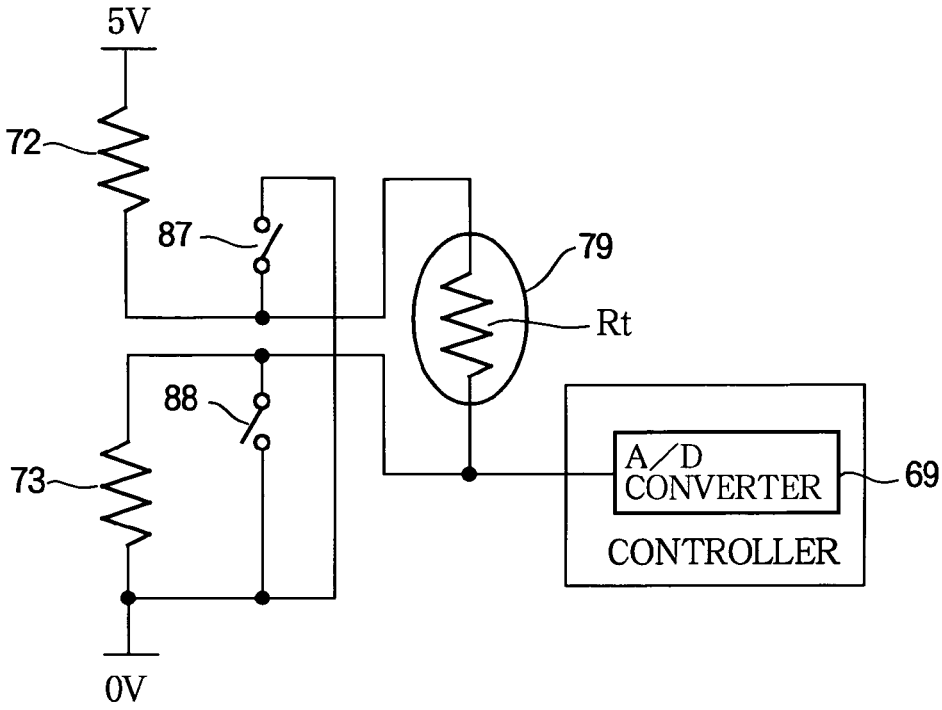
FIG. 3 is an electrically equivalent circuit of the first embodiment.

FIG. 3 is an electrically equivalent circuit of the first embodiment that employs the thermistor 70A, illustrating the temperature-sensing element 79, conductors 75*a* and 75*b*, base plates 80*a* and 80*b*, and voltage-dividing resistors 72 and 73. The base plate 80*a* and 80*b* are used as both signal lines and reinforcing plates.

Figure 4:
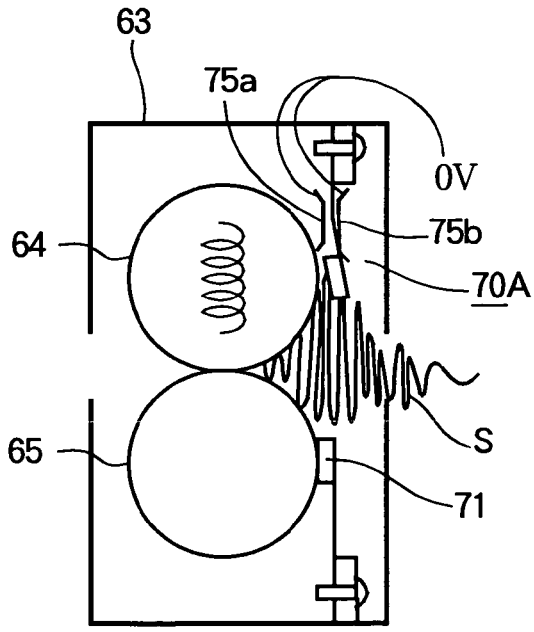
FIG. 4 illustrates a fixing unit when paper jam like an accordion occurs.

Switches 87 and 88 represent an electrically equivalent circuit of the contacts between the base plates 80*a* and 80*b* and the conductors 75*a* and 75*b*. When no paper jam has occurred, the switch 87 or 88 is open. When paper jam like an accordion as shown in FIG. 4 occurs near an entrance of the fixing unit 63 during printing, the jammed paper pushes the temperature-sensing element 79 and the base plates 80*a* and 80*b*. This causes the temperature-sensing element 79 to move out of contact with the fixing roller 64. Then, the base plate 80*a* or 80*b* moves into contact with the conductor 75*a* or 75*b* to close the switch 87 or 88.

When the paper jam has not occurred, the switches 87 and 88 are open and the voltage (Vt) detected by an A/D converter 69 in the controller is given by $$V(t)=5*R73/(R72+R(t)+R73)$$

where R72 is the resistance of the resistor 72, R73 is the resistance of the resistor 73, R(t) is the resistance of the temperature-sensing element 79 that reflects the surface temperature of the fixing roller 64, and the numeral 5 denotes the supply voltage in volts for temperature detection.

Figure 5:
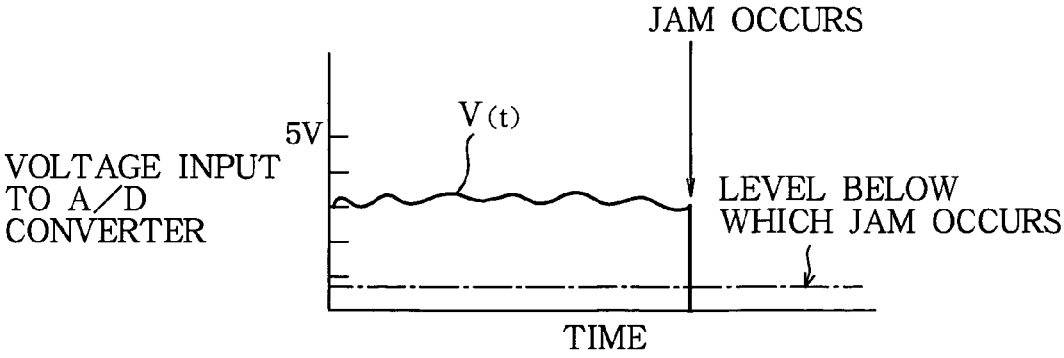
FIG. 5 illustrates analog waveforms before and after the occurrence of paper jam.

FIG. 5 illustrates analog waveforms before and after the occurrence of paper jam. A high voltage is input to the A/D converter 69 when no paper jam occurs. When the switch 87 or 88 is closed due to the occurrence of paper jam, the voltage V(t) falls to 0 V.

Experiment was conducted to determine an input voltage to the A/D converter 69 when the fixing unit 63 operates normally, and an input voltage when the temperature-sensing element 79 of the thermistor 70A has moved out of contact with the fixing roller 64. Then, if an input voltage to the A/D converter 69 is lower than the normal value by more than a predetermined value, then it is determined that the temperature-sensing element 79 of the thermistor 70A has moved out of contact with the fixing roller 64. The controller receives the output of the A/D converter 69 and generates an alarm signal.

Once it is detected that the temperature-sensing element 79 of the thermistor 70A has moved out of contact with the fixing roller 64, the operation of the fixing unit 63 will not performed any further unless the jammed paper is removed and the thermistor 70A returns to its normal position. If the base plate(s) of the thermistor 70A has deformed permanently, at least one of the base plates 80*a* and 80*b* remains in contact with one of the conductors 75*a* and 75*b*. Thus, the input voltage to the A/D converter is 0 V even after the jammed paper has been removed.

Second Embodiment

Figure 6:
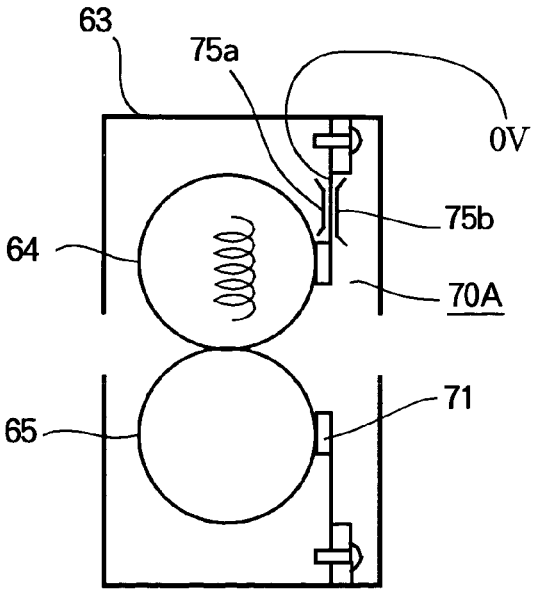
FIG. 6 illustrates a fixing unit and a contact type thermistor that are employed in a second embodiment.

FIG. 6 illustrates a fixing unit 63 and a contact type thermistor 70A that are employed in a second embodiment. The configuration of the second embodiment differs from the prior art in that base plates 80*a* and 80*b* that support a temperature-sensing element 79 are positioned midway between conductors 75*a* and 75*b* closely positioned. The base plate 80*a* and 80 are made of a resilient material. The second embodiment may employ either of the contact type thermistor in FIG. 1A and the non-contact type thermistor in FIG. 1B. The second embodiment will be described with respect to a case in which the non-contact type thermistor in FIG. 1B is employed. Two lines are electrically isolated from a base plate 76 by means of an insulator 78, and are led out from the temperature-sensing element 79. This type of thermistor has an electrically conductive base plate 76 that is used as both a signal line and a reinforcing plate. The base plate 76 is made of a resilient material.

Figure 7:
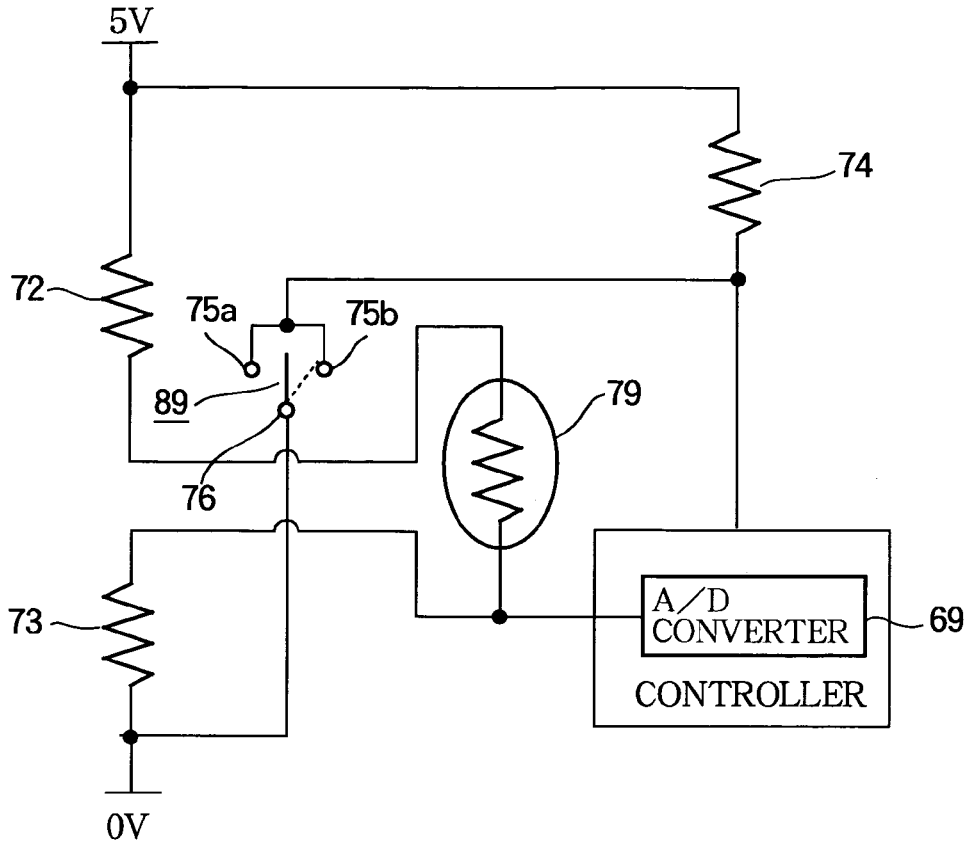
FIG. 7 is an electrically equivalent circuit of the second embodiment.

FIG. 7 illustrates an electrically equivalent circuit that includes voltage-dividing resistors 72 and 73, temperature-sensing element 79, conductors 75*a* and 75*b*, and base plates 80*a* and 80*b*. A switch 89 represents the contacts between the base plates 80*a* and 80*b* of the thermistor 70A and the conductors 75*a* and 75*b*. The resistor 74 has one end connected to an input port of an A/D converter 69 in the controller and the conductors 75*a* and 75*b*, another end connected to the 5-V power supply for the controller.

When no paper jam has occurred, there are a gap between the base plate 76 and the conductor 75*a* and a gap between the base late 76 and the conductor 75*b*, so that the switch 89 is not closed. Therefore, the base plate 76 is not electrically continuous to the conductors 75*a* and 75*b*. In other words, when the switch 89 is not closed to the conductor 75*a* or 75*b*, the input port of the A/D converter 69 is at an "H" level, which is substantially equal to the supply voltage (e.g., 5 V) of the controller.

Figure 8:
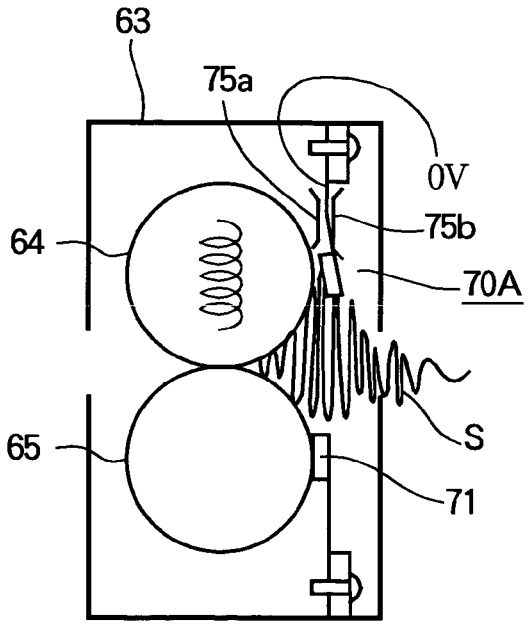
FIG. 8 illustrates the fixing unit in the second embodiment when paper jam like an accordion occurs.

If paper jam like an accordion as shown in FIG. 8 occurs near the entrance of the fixing unit 63 during printing, the jammed paper S pushes the thermistor 70A and the base plate 76. This causes the temperature-sensing element 79 of the thermistor 70A to move out of contact with a fixing roller 64 and the base plate 76 moves into contact with the conductor 75*b* to close the switch 89.

Figure 9:
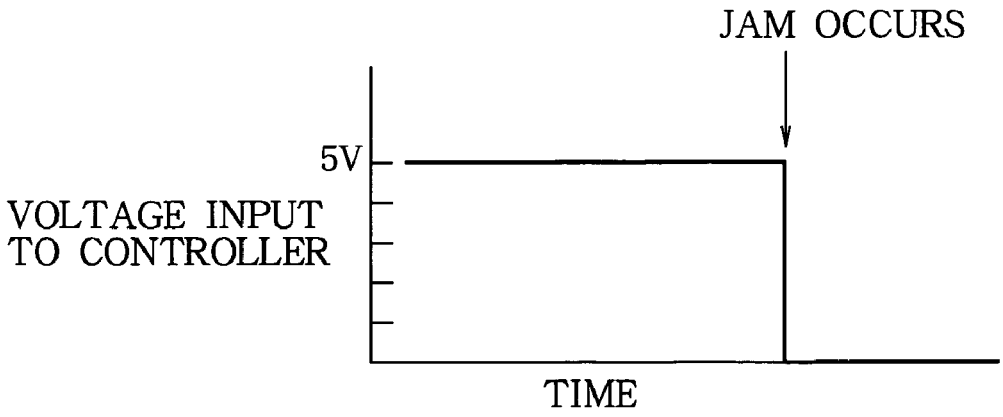
FIG. 9 illustrates analog voltage waveforms in the second embodiment before and after the occurrence of paper jam.

FIG. 9 illustrates analog voltage waveforms before and after the occurrence of paper jam. The voltage at the input of the A/D converter 69 is at the "H" level before paper jam, and at an "L" level after the occurrence of paper jam.

When no paper jam has occurred, the common terminal of the switch 89 is positioned midway between the conductors 75*a* and 75*b* and the input of the A/D converter is at nearly 5 V, so that the "H" level is detected. When the switch 89 is closed to the conductor 75*b*, the voltage at the input of the A/D converter 69 falls to 0 V, so that the "L" level is detected. Thus, the A/D converter 69 detects that the temperature-sensing element 79 of the thermistor 70A has moved out of contact with the fixing roller 64, and generates an alarm signal. If an input voltage to the A/D converter 69 is lower than the normal value by more than a predetermined value, then it is determined that the temperature-sensing element 79 of the thermistor 70A has moved out of contact with the fixing roller 64.

When it is detected that the temperature-sensing element 79 has moved out of contact with the fixing roller 64, the operation of the fixing unit 63 will not be performed any further unless the jammed paper S is removed and the thermistor 70A returns to its normal position. That is, the operation of the fixing unit 63 will not be performed any further until the base plate 76 is positioned midway between the conductors 75*a* and 75*b* again. If the base plate 76 has deformed permanently, the detection signals of the controller or the A/D converter 69 continues to indicate that the thermistor 70A has moved out of contact engagement with the fixing roller 64. Thus, the operation of the fixing unit 63 will not be performed any further.

Third Embodiment

Figure 10:
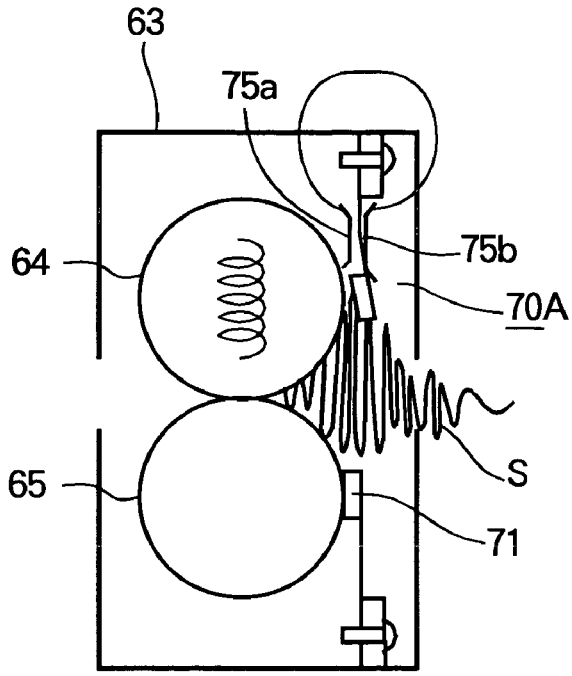
FIG. 10 illustrates a fixing unit according to a third embodiment.

FIG. 10 illustrates a fixing unit 63 according to a third embodiment. The third embodiment differs from the conventional art in that base plates 80*a* and 80*b* that support a temperature-sensing element 79 of a thermistor 70A is positioned midway between conductor 75*a* and 75*b*. The base plate 80*a* and 80 are made of a resilient material. The third embodiment can employ either of two types of thermistor as shown in FIG. 1A (contact type) and FIG. 1B (non-contact type). Here, the third embodiment will be described with respect to the contact type in FIG. 1A.

Figure 11:
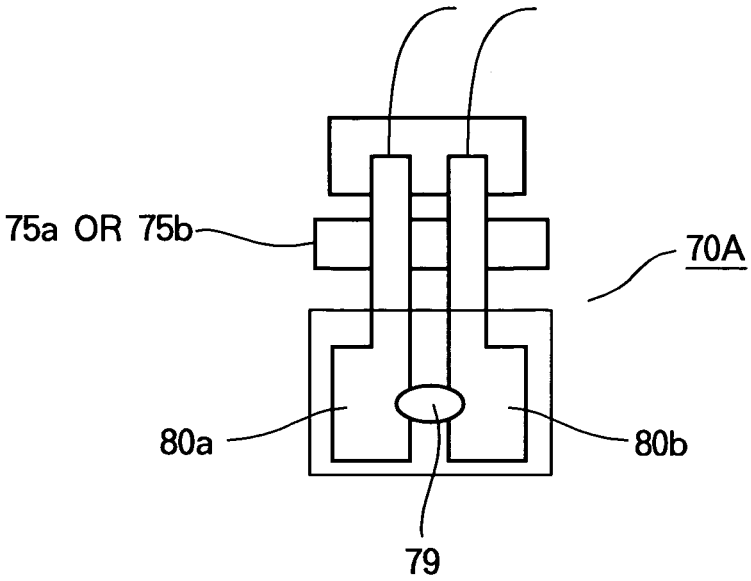
FIG. 11 illustrates a thermistor according to the third embodiment.

FIG. 11 illustrates the thermistor 70A according to the third embodiment. As shown in FIG. 11, the electrically conductive base plates 80*a* and 80*b* support the temperature-sensing element 79 and are used as both signal lines and a reinforcing plate. When the temperature-sensing element 79 of the thermistor 70A moves out of contact with a fixing roller 64, the base plates 80*a* and 80*b* move into contact with the conductors 75*a* and 75*b* at substantially the same time. As a result, there is electrical continuity between the base plates 80*a* and 80*b*.

Figure 12:
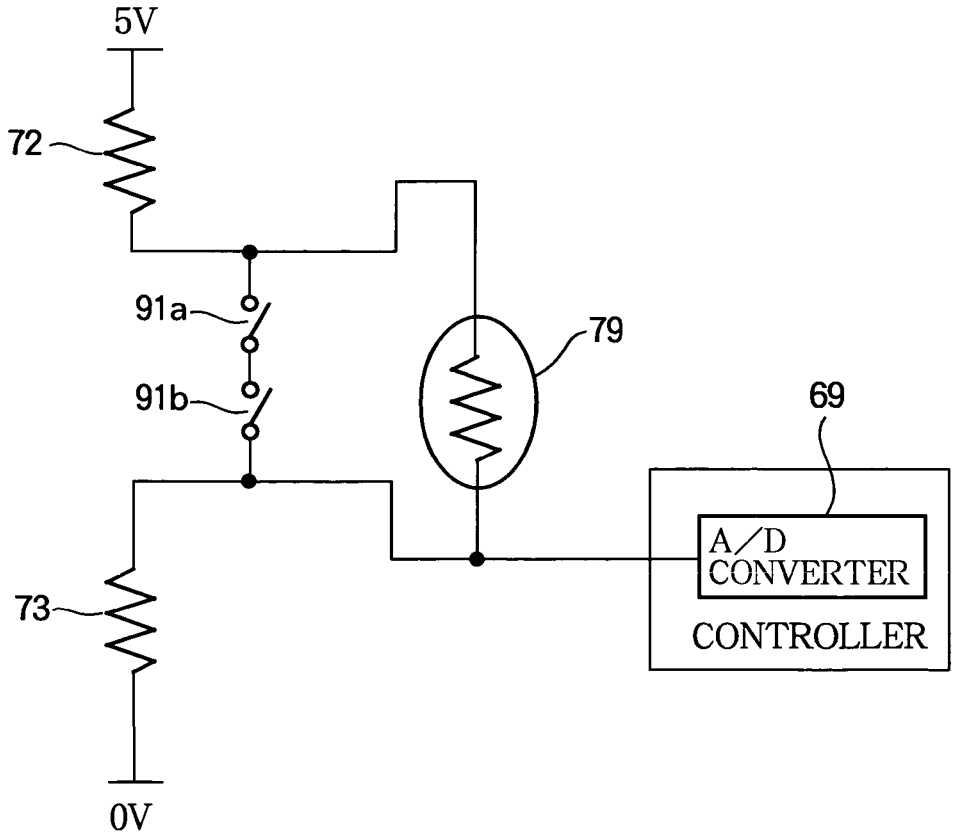
FIG. 12 is an electrically equivalent circuit of the third embodiment.

FIG. 12 is an electrically equivalent circuit that includes voltage-dividing resistors 72 and 73, temperature-sensing element 79, base plates 80*a* and 80*b*, and conductors 75*a* and 75*b*. Switches 91*a* and 91*b* represent the contacts between the base plates 80*a* and 80*b* of the thermistor 70A and the conductors 75*a* and 75*b*, respectively. The conductors 75*a* and 75*b* have one ends connected to the resistors 72 and 73, respectively. When no paper jam occurs, the base plates 80*a* and 80*b* are not in contact with the conductors 75*a* and 75*b*.

When no paper jam occurs, the switch 91 is open. As shown in FIG. 10, if paper jam like an accordion occurs near the entrance of the fixing unit 63 during printing, the jammed paper pushes the thermistor 70A and the base plates 80*a* and 80*b*. This causes the temperature-sensing element 79 of the thermistor 70A to move out of contact with the fixing roller 64. Thus, the base plates 80*a* and 80*b* move into contact with the conductor 75*a* or 75*b*, closing the switches 91*a* and 91*b* in FIG. 12.

Figure 13:
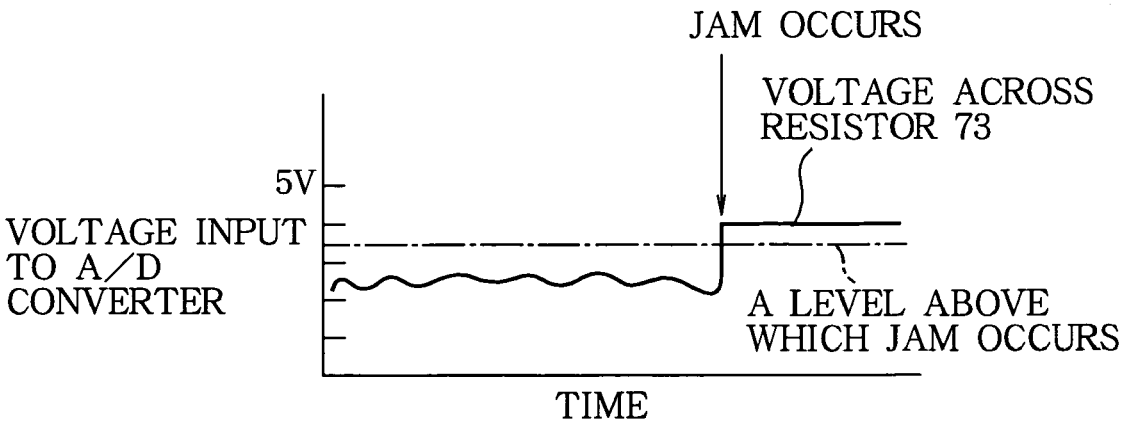
FIG. 13 illustrates analog voltage waveforms in the third embodiment before and after the occurrence of paper jam.

FIG. 13 illustrates analog voltage waveforms before and after the occurrence of paper jam. Before paper jam occurs, the supply voltage is divided by the temperature-sensing element 79 and the voltage-dividing resistors 72 and 73. Thus, the analog voltage before the occurrence of paper jam is the voltage across the resistor 73, the voltage being divided by the temperature sensing element 79 and the voltage dividing resistors 72 and 73. The analog voltage after the occurrence of paper jam is the voltage across the resistor 73, the voltage being divided by the voltage dividing resistors 72 and 73.

When no paper jam occurs, the switches 91*a* and 91*b* are open. The voltage (Vt) detected in the A/D converter 69 in the controller is given by $$V(t)=5*R73/(R72+R(t)+R73)$$

where R72 is the resistance of the voltage-dividing resistor R72, R73 is the resistance of the voltage-dividing resistor R73, R(t) is the resistance of the temperature-sensing element 79 that reflects the surface temperature of the fixing roller 64, and the supply voltage for temperature detection is 5 V.

When no paper jam occurs, the switches 91*a* and 91*b* are closed and the resistance R(t) of the temperature-sensing element 79 that reflects the surface temperature t of the fixing roller 64 is short-circuited. Thus, the voltage (Vt) detected in the A/D converter 69 in the controller is given by $$V(t)=5*R73/(R72+R73)$$

As described above, when the voltage V(t) changes, the controller determines that the temperature-sensing element 79 of the thermistor 70A has moved out of contact with the fixing roller 64, and generates an alarm signal.

FIG. 13 illustrates analog voltage waveforms before and after the occurrence of paper jam. The voltage is at an "L"

level before the occurrence paper jam, and at an "H" level after the occurrence of paper jam. As described above, when no paper jam occurs, the voltage detected by the A/D converter 69 reflects the surface temperature of the fixing roller 64. When paper jam occurs, the voltage detected by the A/D converter 69 is a fixed voltage that is divided by the voltage-dividing resistors R72 and R73. If an input voltage to the A/D converter 69 is lower than the normal value by more than a predetermined value, then it is determined that the temperature-sensing element 79 of the thermistor 70A has moved out of contact with the fixing roller 64.

Once paper jam occurs, the operation of the fixing unit 63 will not performed any further unless the jammed paper S is removed and the thermistor 70A has returned to its normal position. That is, the operation of the fixing unit 63 will not be performed any further until the base plates 8*a* and 80*b* are positioned midway between the conductors 75*a* and 75*b* and therefore the thermistor 70A is again in contact with the fixing roller 64. If the base plates 80*a* and 80*b* of the thermistor 70A have deformed permanently, the base plates 80*a* and 80*b* remain in contact with either of the conductors 75*a* and 75*b*. Thus, the detection signal of the A/D converter 69 continues to indicate that the temperature-sensing element 79 of the thermistor 70A has moved out of contact with the fixing roller 64, and the operation of the fixing unit 63 will not be performed any further.

The first and second embodiments require the wiring materials that connect the switch (FIG. 3) to 0 V. The second embodiment requires the resistor 74 (FIG. 7) that detects a change in voltage. On the contrary, the third embodiment eliminates the need for the switch and wiring materials resistor 74. The non-contact type thermistor may also be used in the third embodiment.

Fourth Embodiment

Figure 14:
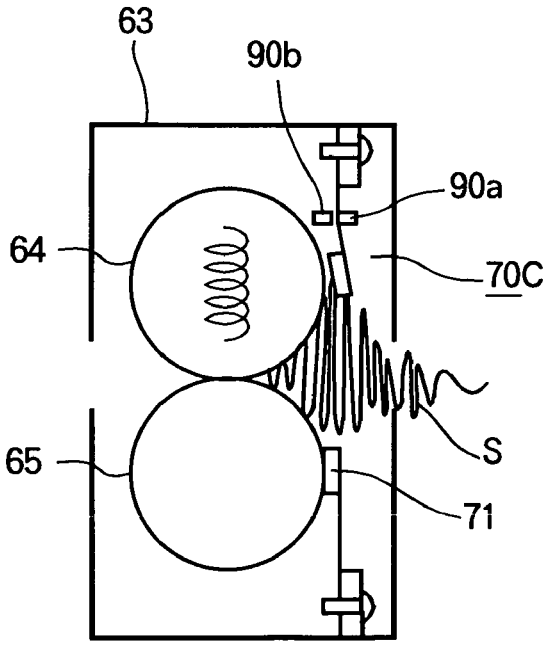
FIG. 14 illustrates a thermistor and a fixing unit according to a fourth embodiment.
Figure 15A:
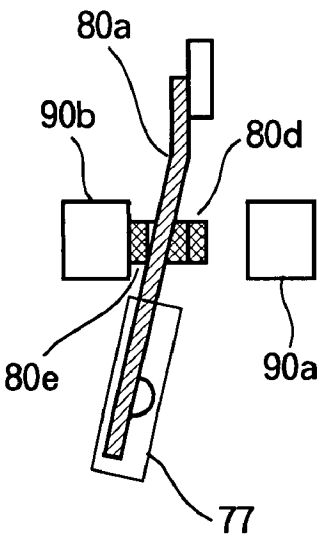
FIGS. 15A–15D illustrate the details of the thermistor according to the fourth embodiment.
Figure 15B:
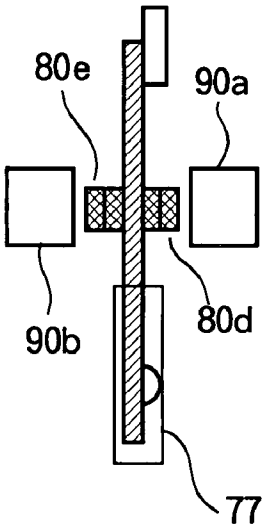
Figure 15C:
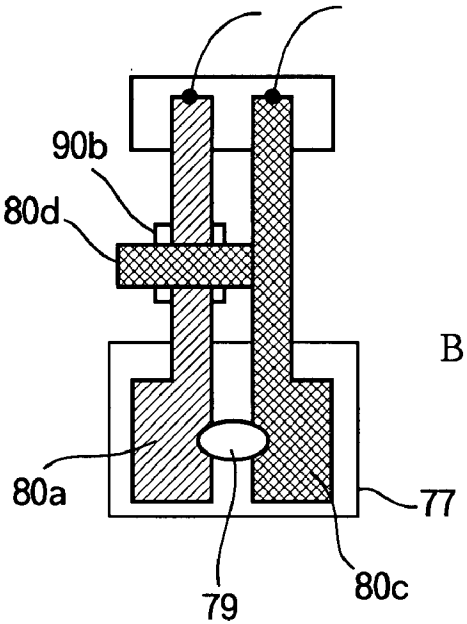
Figure 15D:
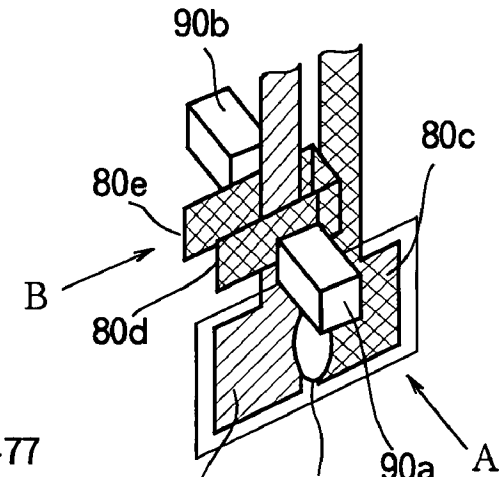

FIG. 14 illustrates a thermistor 70C and a fixing unit 63 according to a fourth embodiment. FIGS. 15A–15D illustrate the details of the thermistor 70C according to the fourth embodiment. FIGS. 15A and 15B are side views as seen in a direction shown by arrow B in FIG. 15D. FIG. 15C is a front view as seen in a direction shown by arrow A in FIG. 15D. FIG. 15D is a perspective view of the thermistor 70C.

The fourth embodiment differs from the conventional art in that base plates 80*a* and 80*b* that support the thermistor 70C are positioned midway between stoppers 90*a* and 90*b* that are closely positioned. The base plate 80*a* and 80 are made of a resilient material. The fourth embodiment employs the thermistor in FIGS. 15A–15D. The thermistor according to the fourth embodiment is similar to that of FIG. 1A but differs in that projections 80*d* and 80*e* extend in parallel with each other from, for example, the base plate 80*c*, and the base plate 80*a* extends midway between the projections 80*d* and 80*e*. When no paper jam occurs, the projections 80*d* and 80*e* are not in contact with the base plate 80*a*.

For a case where the thermistor illustrated in FIGS. 15A–15D is used, a description will be given of the operation of detecting that the temperature-sensing element 79 of the thermistor 70C has moved out of contact a fixing roller 64.

When paper jam like an accordion as shown in FIG. 14 occurs near an entrance of the fixing unit 63 during printing, the jammed paper S pushes the thermistor 70C and the base plates 80*a* and 80*c*. This causes the temperature-sensing element 79 of the thermistor 70C to move out of contact with the fixing roller 64. Further, the projection 80*d* or 80*e* abuts stopper 90*a* or 90*b*, so that the projection 80*d* or 80*e* will deform to move into contact with the base plate 80*a*. When the jammed paper S pushes the base plates 80*a* and 80*c*, the base plates 80*a* and 80*c* deform as shown in FIG. 15A, so that the projection 80*e* and the base plate 80*a* abut the stopper 90*b* to make good electrical contact between the 80*a* and 80*e*.

Figure 16:
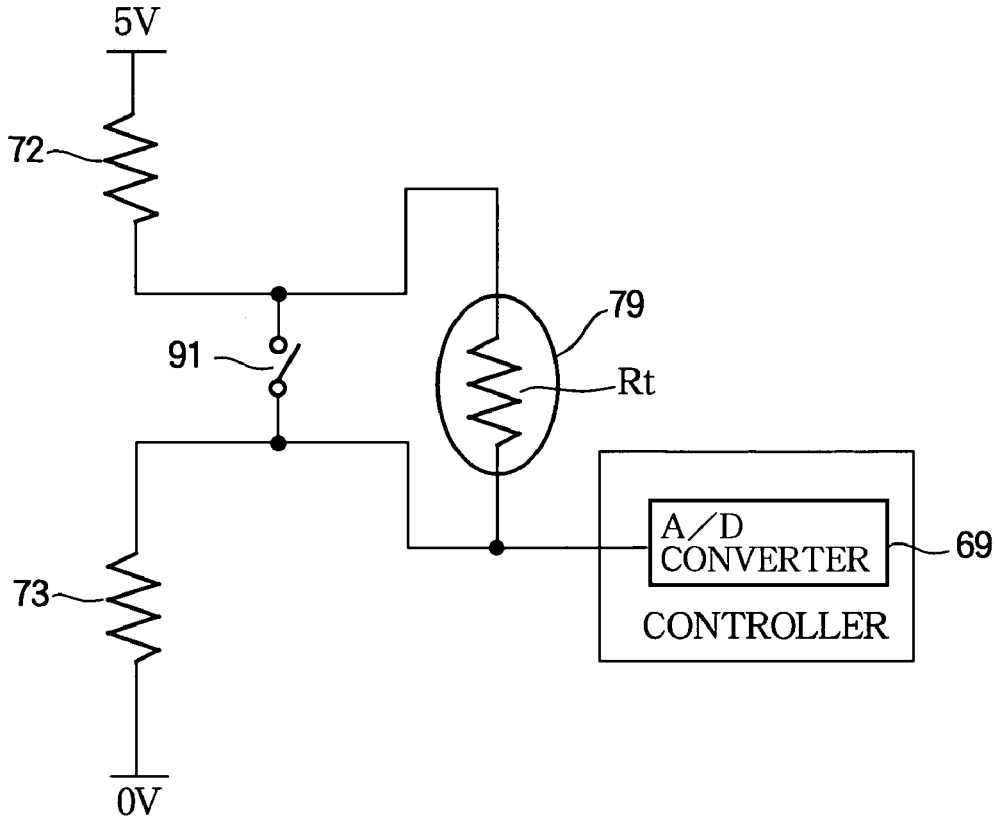
FIG. 16 illustrates an electrically equivalent circuit of the fourth embodiment.

FIG. 16 illustrates an electrically equivalent circuit that includes voltage-dividing resistors 72 and 73, the temperature-sensing element 79, the base plates 80*a* and 80*c*, and the projections 80*e* and 80*d*. A switch 91 represents the contacts between the projections 80*e* and 80*d* and the base plate 80*a*.

When no paper jam occurs, the switch 91 is open. When paper jam like an accordion as shown in FIG. 14 occurs near an entrance of the fixing unit 63 during printing, the jammed paper S pushes the thermistor 70C and the base plates 80*a* and 80*c*. This causes the temperature-sensing element 79 of the thermistor 70C to move out of contact with the fixing roller 64. Further, the base plate 80*a* or the base plate 80*c* moves into contact with the projections 80*e* and 80*d*, so that the switch 91 in FIG. 16 is closed.

When the paper jam S has not occurred, the switch 91 is open and the voltage (Vt) detected by the A/D converter 69 of the controller is given by $$V(t)=5*R73/(R72+R(t)+R73)$$

where R72 is the resistance of the voltage-dividing resistor 72, R73 is the resistance of the voltage-dividing resistor R73, R(t) is the resistance of the thermistor 70C that reflects the surface temperature of the fixing roller 64, and numeral 5 denotes the supply voltage in volts for temperature detection.

When paper jam has occurred, the switch 91 is closed and the voltage across the thermistor 70C (i.e., temperature-sensing element 79) is zero volts. Thus, the voltage V(t) is given by $$V(t)=5*R73/(R72+R73).$$

Figure 17:
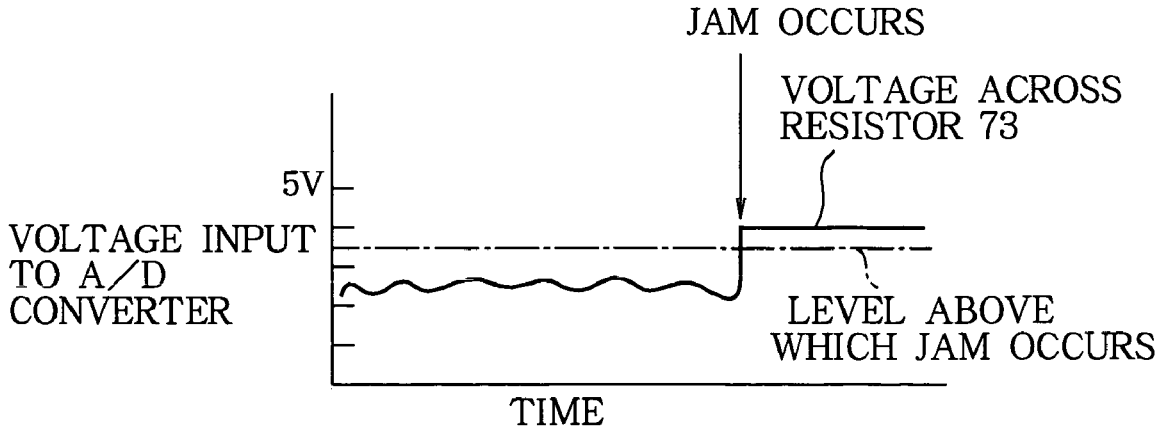
FIG. 17 illustrates analog voltage waveforms in the fourth embodiment before and after the occurrence of paper jam.

FIG. 17 illustrates analog voltage waveforms before and after the occurrence of paper jam. Before paper jam occurs, the supply voltage is divided by the temperature-sensing element 79 and the voltage-dividing resistors 72 and 73. Thus, the analog voltage before the occurrence of paper jam is the voltage across the resistor 73, the supply voltage being divided by the voltage dividing resistors 72 and 73 and the temperature sensing element 79. The analog voltage after the occurrence of paper jam is the voltage across the resistor 72, the supply voltage being divided by the voltage dividing resistors 72 and 73.

If an input voltage to the A/D converter 69 is lower than the normal value by more than a predetermined value, the controller determines that the temperature-sensing element 79 of the thermistor 70C has moved out of contact with the fixing roller 64, and generates an alarm signal.

Once paper jam occurs, the operation of the fixing unit 63 will not performed any further unless the jammed paper S is removed and the thermistor 70C returns to its normal position where the thermistor 70C is in contact with the fixing roller 64. If the base plate of the thermistor 70C has deformed permanently, the detection signal from the A/D converter 69 continues to indicate that the temperature-sensing element 79 of the thermistor 70C is out of contact with the fixing roller 64. Thus, the operation of the fixing unit 63 will not be performed any further.

The first and second embodiments require the wiring materials that connect the switch to a potential of 0 V. The second embodiment requires the resistor 74 for detecting a change in voltage. On the contrary, the fourth embodiment eliminates the need for these wiring materials and the resistor. The non-contact type thermistor may also be used in the fourth embodiment.

Fifth Embodiment

Figure 18:
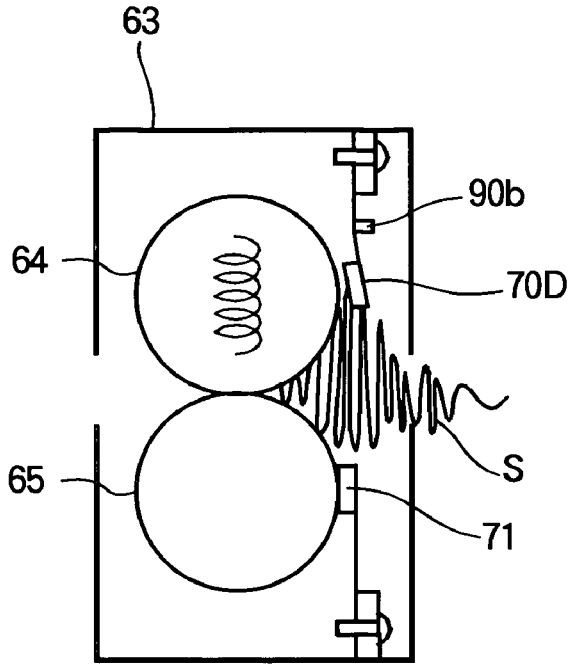
FIG. 18 illustrates a fixing unit and a contact type thermistor that are employed in a fifth embodiment.

FIG. 18 illustrates a fixing unit 63 and a contact type thermistor 70D that are employed in a fifth embodiment. The configuration of the fifth embodiment has the feature that a base plate 84 is fixed to a temperature-sensing element 79 and a base plate 83 is movable into and out of contact with the base plate 84. The base plate 83 and 84 are made of a resilient material.

Figures 19A, 19B, 19C:
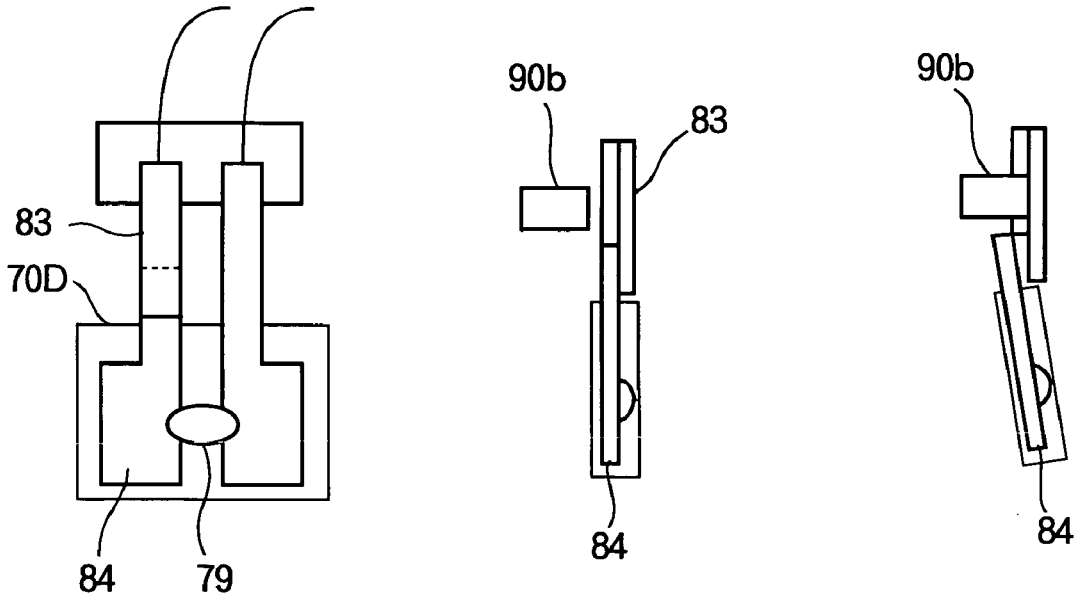
FIGS. 19A–19C illustrate the configuration of the thermistor according to the fifth embodiment.

FIGS. 19A–19C illustrate the configuration of the thermistor 70D. The thermistor 70D includes the base plates 83 and 84 that are movable into and out of contact engagement with each other. The thermistor 70D further includes a base plate 85 made of a resilient material. The base plates 84 and 85 are electrically connected to each other via a temperature-sensing element 79. When paper jam does not occurred, the base plate 83 remains in electrical contact engagement with the base plate 84. When paper jam occurs, the base plates 83 and 84 deform such that the base plate 83 abuts a stopper 90*b* and the base plate 84 moves out of contact with the base plate 83.

With respect to a case where the thermistor illustrated in FIGS. 19A–19C is used, a description will be given of the operation of detecting that the temperature-sensing element 79 of the thermistor 70D has moved out of contact with a fixing roller 64.

When paper jam like an accordion as shown in FIG. 18 occurs near an entrance of the fixing unit 63 during printing, the jammed paper S pushes the thermistor 70D and the base plates 80*a* and 80*b*. This causes the temperature-sensing element 79 of the thermistor 70D to move out of contact with the fixing roller 64. The stopper 90*b* interferes with the base plate 83 causing the base plate 84 to move out of contact with the base plate 83.

Figure 20:
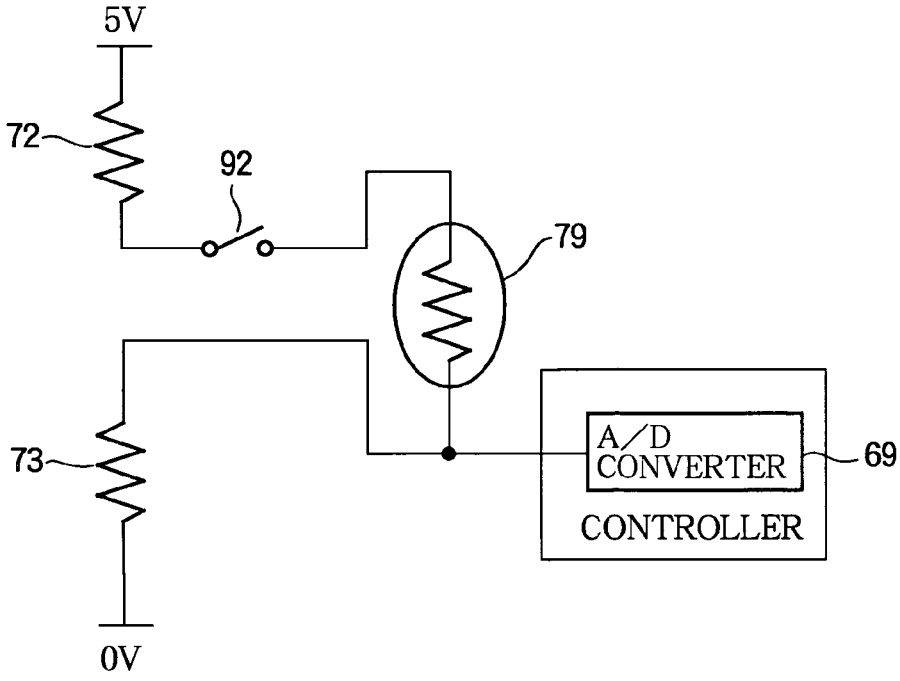
FIG. 20 is an electrically equivalent circuit of the fifth embodiment.

FIG. 20 is an electrically equivalent circuit that includes the voltage-dividing resistors 72 and 73, temperature-sensing element 79, and base plates 83 and 84. A switch 92 represents the contact between the base plate 83 and the base plate 84.

When no paper jam occurs, the switch 92 remains closed. When paper jam like an accordion as shown in FIG. 18 occurs near an entrance of the fixing unit 63 during printing, the jammed paper S pushes the thermistor 70D and the base plate 84. This causes the temperature-sensing element 79 of the thermistor 70D to move out of contact with the fixing roller 64. Moreover, the base plate 84 moves out of contact with the base plate 83 to open the switch 92. When the switch 92 opens, the 5-V power supply is shut off so that the voltage across the resistor 73 falls to 0 V.

When no paper jam occurs, the switch 92 remains closed and the voltage (Vt) detected by the A/D converter 69 of the controller is given by $$V(t)=5*R73/(R72+R(t)+R73)$$

where R72 is the resistance of the resistor 72, R73 is the resistance of the resistor R73, R(t) is the resistance of the temperature-sensing element 79 that reflects the surface temperature of the fixing roller 64, and numeral 5 denotes the supply voltage in volts for temperature detection.

When no paper jam has occurred, the switch 92 opens and the voltage V(t) is at 0 V. As described above, in response to the change in the voltage input to the A/D converter 69, the controller detects that the temperature-sensing element 79 of the thermistor 70D has moved out of contact with the fixing roller 64, and generates an alarm signal.

Figure 21:
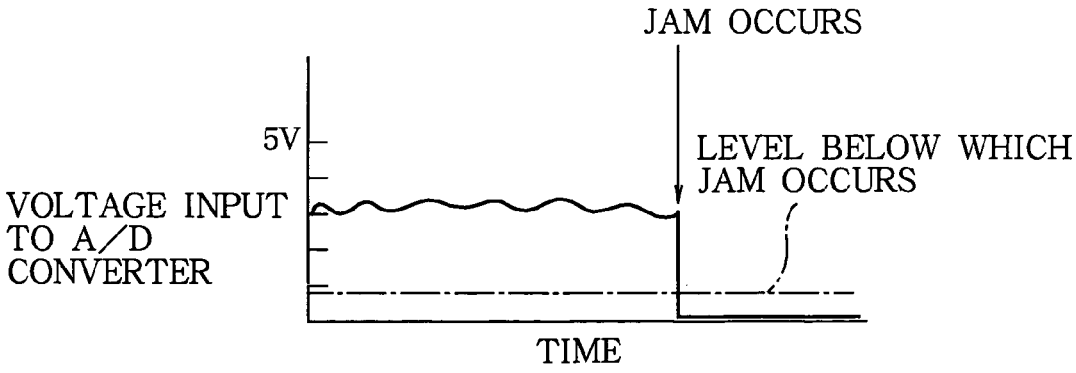
FIG. 21 illustrates analog voltage waveforms in the fifth embodiment before and after the occurrence of paper jam.

FIG. 21 illustrates analog voltage waveforms before and after the occurrence of paper jam. The voltage input to an A/D converter 69 reflects the surface temperature of the fixing roller 64 when no paper jam occurs, and falls to 0 V when paper jam occurs. If an input voltage to the A/D converter 69 is lower than the normal value by more than a predetermined value, the controller determines that the temperature-sensing element 79 of the thermistor 70D has moved out of contact with the fixing roller 64.

When paper jam occurs, the operation of the fixing unit 63 will not be performed any further unless the jammed paper is removed and the thermistor 70D returns to its normal position. When the base plate of the thermistor 70D has deformed permanently, even though the jammed paper is removed, the detection signal of the controller or the A/D converter 69 continues to indicate that the temperature-sensing element 79 is out of contact with the fixing roller 64. Thus, the operation of the fixing unit 63 will not be performed any further.

The fifth embodiment eliminates the need for the wiring materials that were required to connect the switch to 0 V in the first and second embodiments, and the resistor 74 for detecting the change in voltage, which were required in the second embodiment. Because a part of the thermistor serves as an electrical switch, the number of parts required is reduced, providing a simplified configuration. The non-contact type thermistor may also be used in the fifth embodiment.

Sixth Embodiment

Figure 22:
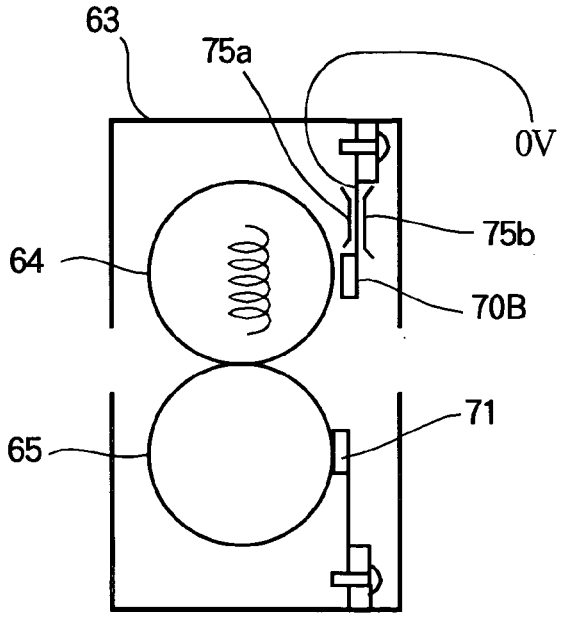
FIG. 22 illustrates a sixth embodiment.

FIG. 22 illustrates a sixth embodiment. The sixth embodiment differs from the conventional art in that a base plate 76 that supports a non-contact type thermistor 70B is positioned midway between conductors 75*a* and 75*b*. The base plate 76 is made of a resilient material. The sixth embodiment may employ either of a contact type thermistor in FIG. 1A and a non-contact type thermistor in FIG. 1B. Here, the sixth embodiment will be described with respect to a case in which the thermistor in FIG. 1B is employed. Two leads are electrically isolated from the base plate 76 by means of an insulator 78, and are led out from the temperature-sensing element 79. This type of thermistor has an electrically conductive base plate 76 that is used as both a signal line and a reinforcing plate. The base plate 76 is connected to a potential of 0 V.

When no paper jam has occurred, the base plate 76 is midway between the conductors 75*a* and 75*b* such that the base plate 76 is not in contact with the conductors 75*a* and 75*b*. When paper jam occurs, the base plate 76 moves into contact with, for example, the conductor 75*b*.

With respect to a case where the thermistor illustrated in FIG. 1B is used, a description will be given of the operation of detecting that the temperature-sensing element 79 of the thermistor 70B has moved out of contact with a fixing roller 64.

Figure 24:
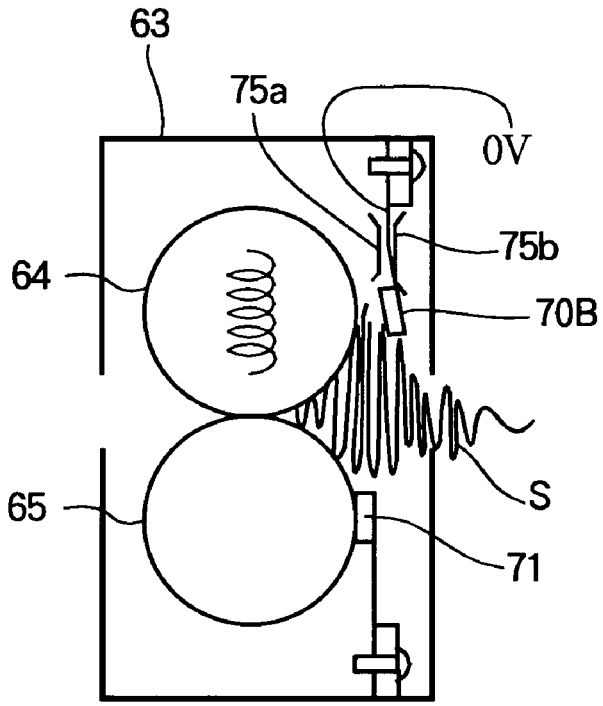
FIG. 24 illustrates a fixing unit according to the sixth embodiment.

When paper jam like an accordion as shown in FIG. 24 occurs near an entrance of the fixing unit 63 during printing, the jammed paper S pushes the thermistor 70B and the base plate 76. This causes the temperature-sensing element 79 of the thermistor 70B to move out of contact with the fixing roller 64. The base plate 76 moves into contact with either the conductor 75*a* or the conductor 75*b*.

Figure 23:
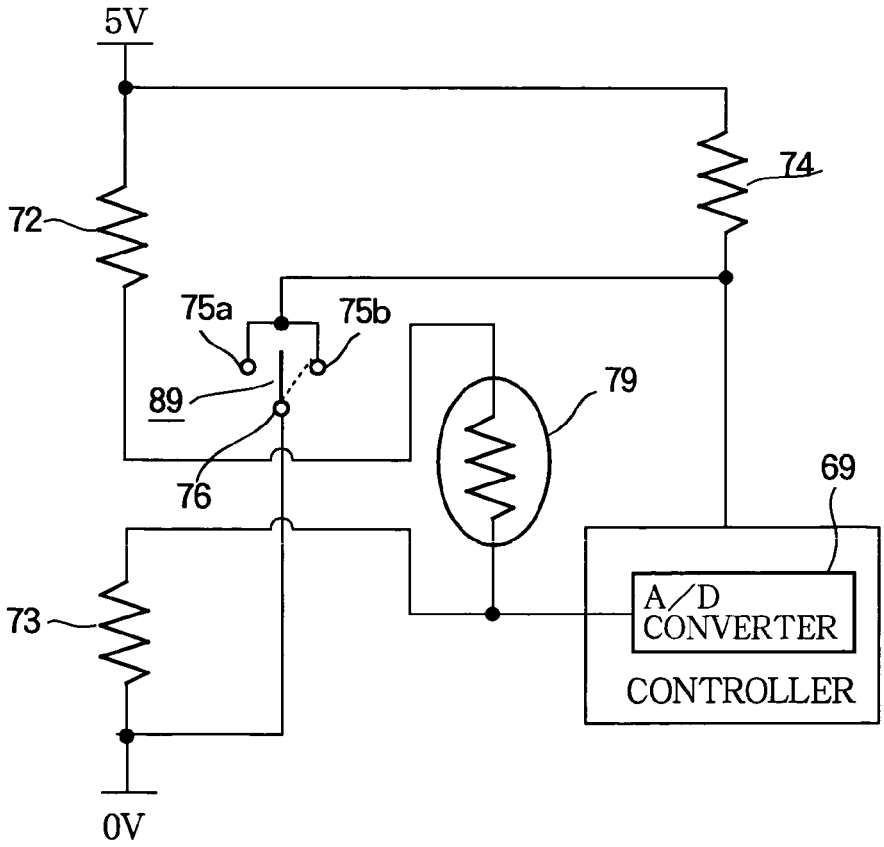
FIG. 23 is an electrically equivalent circuit of the sixth embodiment.

FIG. 23 is an electrically equivalent circuit that includes the voltage-dividing resistors 72 and 7, temperature-sensing element 79, conductors 75*a* and 75*b*, base plate 76, and resistor 74. A switch 89 represents the contacts between the base plate 76 and the conductors 75*a* and 75*b*. The resistor 74 has one end connected to the conductors 75*a* and 75*b* and the input port of the A/D converter 69 in the controller, and another end connected to a 5-V power supply. When no paper jam occurs, the common electrode of the switch 89 is positioned midway between the conductors 75*a* and 75*b*, so that an "H" level appears at the input of the A/D converter 69. When paper jam occurs, the base plate 76 of the thermistor 70B goes into electrical contact with either the conductor 75*a* or the conductor 75*a* or the conductor 75*b*.

A description will be given of the operation of detecting that the temperature-sensing element 79 of the non-contact type thermistor 70B has moved out of contact with the fixing roller 64.

When paper jam like an accordion as shown in FIG. 24 occurs near an entrance of the fixing unit 63 during printing, the jammed paper S pushes the thermistor 70B and the base plate 76. This causes the temperature-sensing element 79 of the thermistor 70B to move out of contact with the fixing roller 64. As shown in FIG. 8, the base plate 76 moves into contact with the conductor 75*b*, causing the switch 89 in FIG. 23 to switch to the conductor 75*b*.

Figure 25:
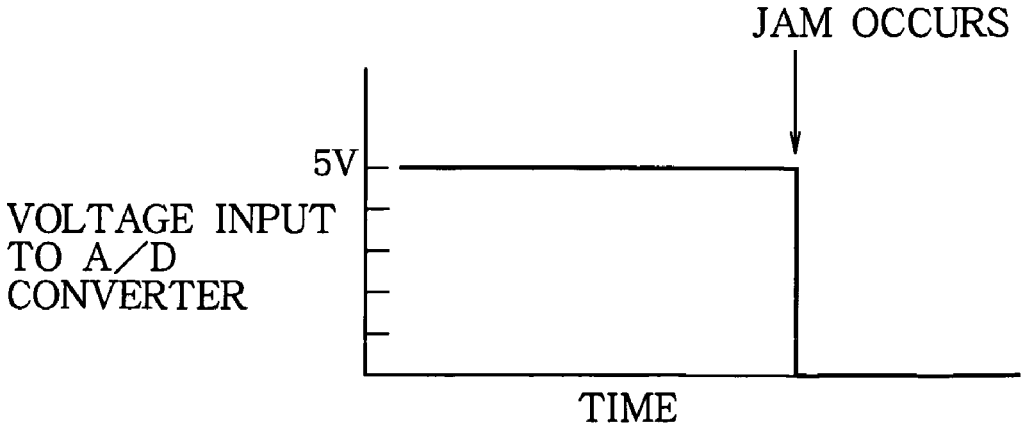
FIG. 25 illustrates analog voltage waveforms in the sixth embodiment before and after the occurrence of paper jam.

FIG. 25 illustrates analog voltage waveforms before and after the occurrence of paper jam. The analog voltage is an "H" level before paper jam occurs and an "L" level (i.e., substantially 0 V) after paper jam occurs. Thus, the voltage input to A/D converter 69 reflects the surface temperature of the fixing roller 64 when no paper jam occurs, and falls to 0 V when paper jam occurs. If an input voltage to the A/D converter 69 is lower than the normal value by more than a predetermined value, the controller determines that the thermistor 70B has moved out of contact with the fixing roller 64.

Once paper jam occurs, the operation of the fixing unit 63 will not be performed any further unless the jammed paper S is removed and the thermistor 70B returns to its normal position. If the base plate 76 of the thermistor 70B has deformed permanently, the output of the A/D converter 69 continues to indicate that the thermistor 70B is out of contact with the fixing roller 64 even though the jammed paper S is removed. Thus, the operation of the fixing unit 63 will not be performed any further. The sixth embodiment has been described with respect to the same configuration as the second embodiment except that a non-contact type thermistor is used instead of the contact type thermistor.

Seventh Embodiment

Figure 26:
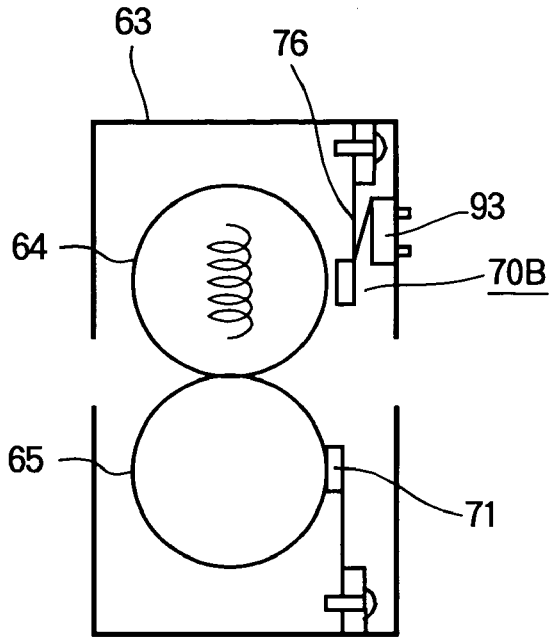
FIGS. 26 and 27 illustrate the configuration of a seventh embodiment.
Figure 27:
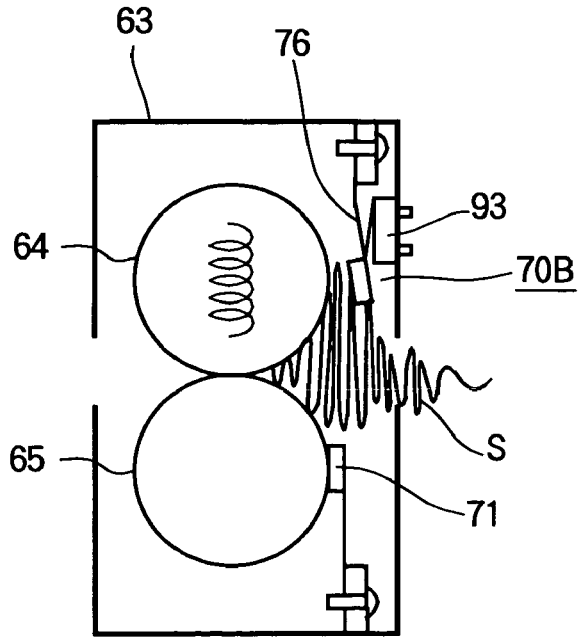

FIGS. 26 and 27 illustrate the configuration of a seventh embodiment. The seventh embodiment differs from the conventional art in that a switch 93 is employed. Referring to FIG. 26, when a non-contact type thermistor 70B moves a predetermined distance in such a direction as to be away from a fixing roller 64, the switch 93 is driven by an electrically conductive base plate 76 of the thermistor 70B to close as shown in FIG. 27. The base plate 76 is made of a resilient material. The seventh embodiment may employ either of the type in FIG. 1A and the type in FIG. 1B. Here, the seventh embodiment will be described with respect to a case in which the non-contact type thermistor of the type in FIG. 1B. The thermistor of FIG. 1B includes two signal lines isolated by an insulator 78 from a base plate 76 that supports a temperature-sensing element 79.

Figure 28:
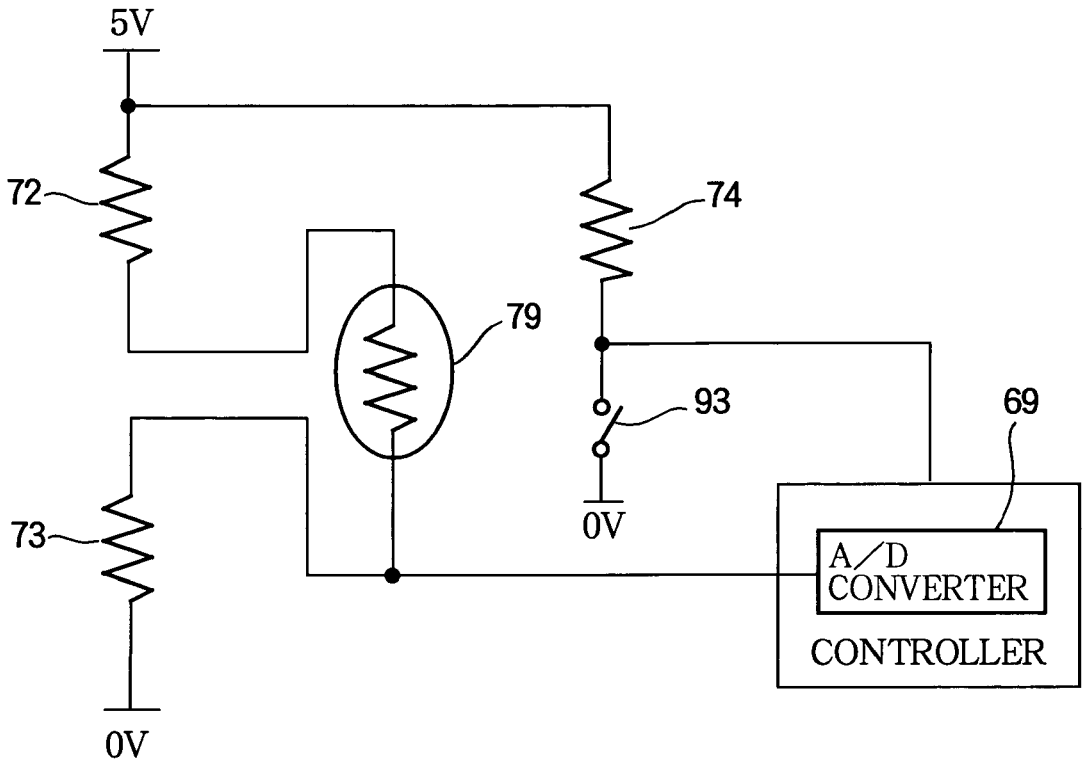
FIG. 28 is an electrically equivalent circuit of the seventh embodiment.

FIG. 28 is an electrically equivalent circuit that includes the voltage-dividing resistors 72 and 73, temperature-sensing element 79, base plate 76, and resistor 74. The resistor 74 has one end connected to the input port of a controller and another end connected to a 5-V power supply for the controller. When no paper jam occurs, the switch 93 is open so that the voltage at the input port of the A/D converter 69 is at an "H" level. When paper jam occurs, the switch 93 is closed so that the voltage at the input pot of the A/D converter 69 is at an "L" level, which is substantially 0 V. As shown in FIG. 28, the switch 93 has one end connected to the resistor 74 and the A/D converter, and another end connected to a potential of 0 V.

A description will be given of the operation of detecting that a non-contact type thermistor 70B has moved out of contact with the fixing roller 64.

When paper jam like an accordion as shown in FIG. 27 occurs near an entrance of a fixing unit 63 during printing, the jammed paper S pushes the thermistor 70B and the base plate 76. This causes the temperature-sensing element 79 of the thermistor 70B to move out of contact with the fixing roller 64. The base plate 76 pushes the switch 93 in FIG. 28 to close the switch 93.

As described above, when the input voltage to the controller falls to 0 V, the controller determines that the temperature-sensing element 79 of the thermistor 70B has moved out of contact with the fixing roller 64, and generates an alarm signal.

Figure 29:
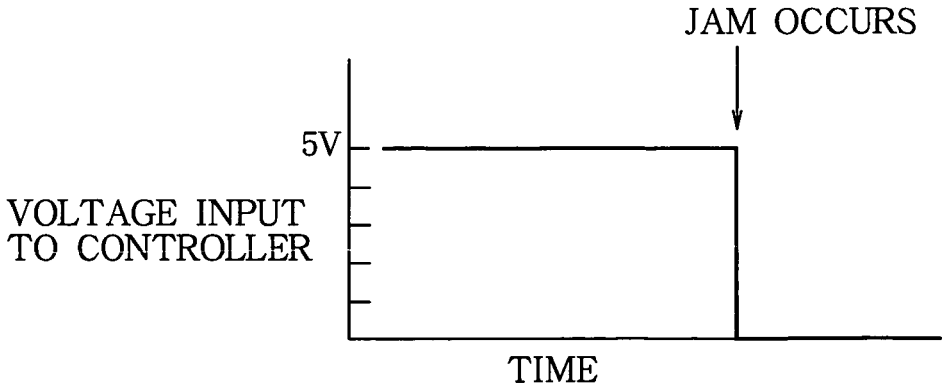
FIG. 29 illustrates analog voltage waveforms in the seventh embodiment before and after the occurrence of paper jam.

FIG. 29 illustrates analog voltage waveforms before and after the occurrence of paper jam. The analog voltage is at an "H" level before paper jam occurs and at an "L" level (substantially 0 V) after paper jam has occurred. Thus, once paper jam occurs, the voltage input to A/D converter 69 no longer reflects the surface temperature of the fixing roller 64.

Once paper jam occurs, the operation of the fixing unit 63 will not be performed any further unless the jammed paper S is removed and the thermistor 70B returns to its normal position. If the baseplate 76 of the thermistor 70B has deformed permanently, the output of the A/D converter 69 in the controller continues to indicate that the thermistor 70B is out of contact with the fixing roller 64 even though the jammed paper is removed. Thus, the operation of the fixing unit 63 will not be performed any further. The seventh embodiment is of the same configuration as the second embodiment except that a non-contact type thermistor is used instead of the contact type thermistor.

Eighth Embodiment

Figure 30:
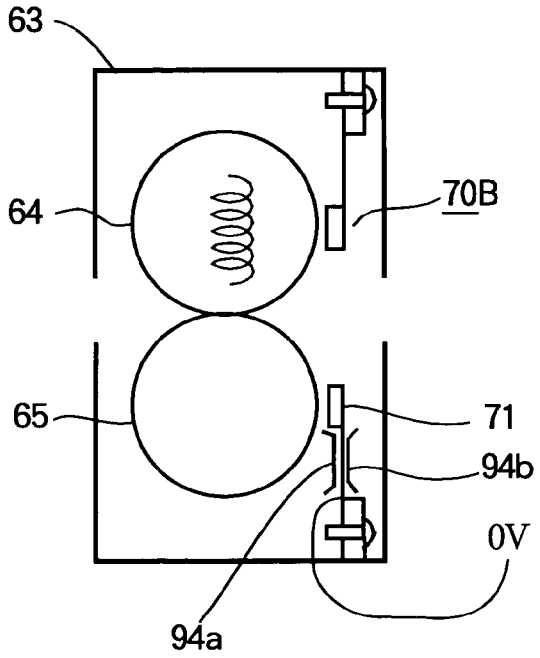
FIG. 30 illustrates the configuration of an eighth embodiment.

FIG. 30 illustrates the configuration of an eighth embodiment. The eighth embodiment differs from the conventional art in that an electrically conductive base plate 76 is midway between conductors 94*a* and 94*b*. The base plate 76 is made of a resilient material. The eighth embodiment may employ either of the type in FIG. 1A and the type in FIG. 1B. Here, the eighth embodiment will be described with respect to a case in which a thermistor of the type in FIG. 1B. The thermistor 70B of FIG. 1B includes two signal lines isolated by an insulator 78 from the base plate 76 that supports a temperature-sensing element 79. The base plate 76 is connected to a potential of 0 V.

With respect to a case where the thermistor 70B illustrated in FIG. 1B is used, a description will be given of the operation of detecting that the thermistor 70B has moved out of contact with a pressure roller 65.

Figure 31:
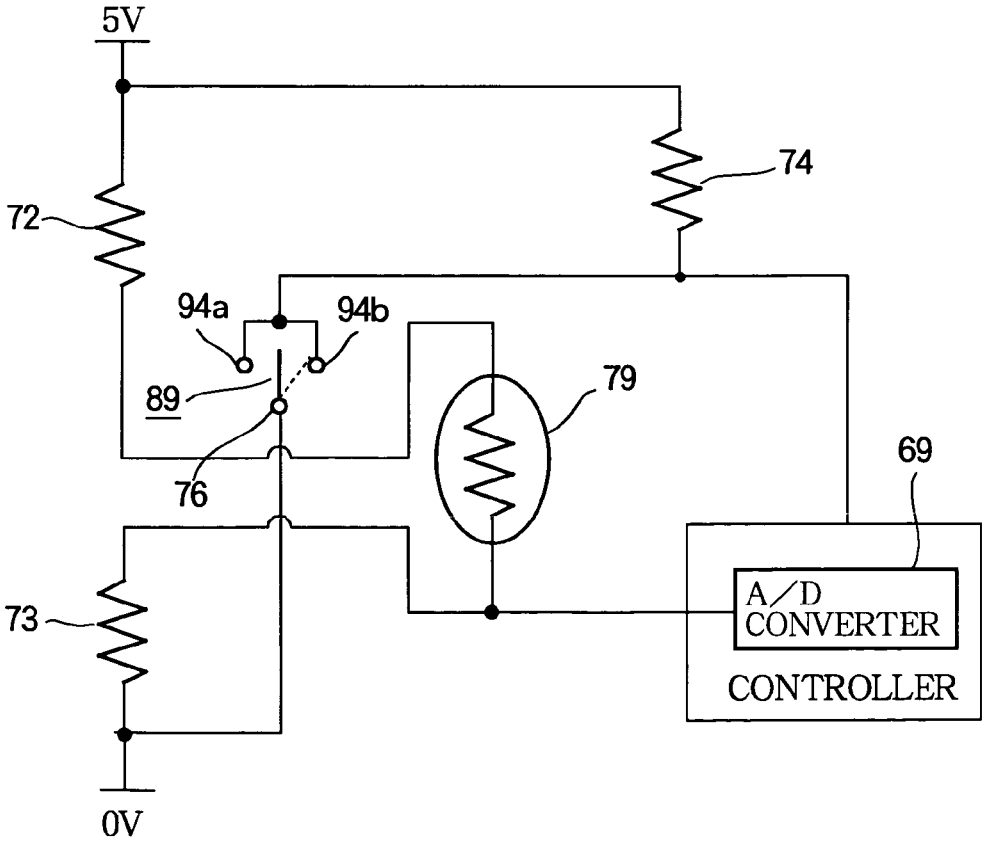
FIG. 31 is an electrically equivalent circuit of the eighth embodiment.

FIG. 31 is an electrically equivalent circuit that includes the voltage-dividing resistors 72 and 73, temperature-sensing element 79, conductors 94*a* and 94*b*, base plate 76, and resistor 74. The resistor 74 has one end connected to the input port of a controller and another end connected to a 5-V power supply for the controller. The base plate 76 and the conductors 94*a* and 94*b* form a switch 89.

When no paper jam occurs, the common electrode of the switch 89 is midway between the conductors 94*a* and 94*b* and the voltage at the input port of the A/D converter 69 in the controller is at an "H" level. When paper jam occurs, the switch 89 is closed so that the voltage at the input of the A/D converter 69 is at an "L" level. As shown in FIG. 31, the switch 89 has one end connected to the resistor 74 and the controller, and another end connected to a potential of 0 V.

The resistor 74 has one end connected to a 5-V power supply and another end connected to the conductors 94*a* and 94*b* and the input port of the A/D converter 69 in the controller. The resistor 74 has one end connected to a 5-V power supply and another end connected to the conductors 94*a* and 94*b* and the input of the A/D converter 69 in the controller. When no paper jam occurs so that the switch 89 is switched to neither the conductor 94*a* nor the conductor 94*b*, the voltage at the input port of the A/D converter 69 is at an "H" level.

A description will be given of the operation of detecting that the non-contact type thermistor 71 has moved out of contact with the pressure roller 65 by a predetermined distance. The thermistor 71 is the same type as the thermistor 70B in FIG. 1B.

Figure 32:
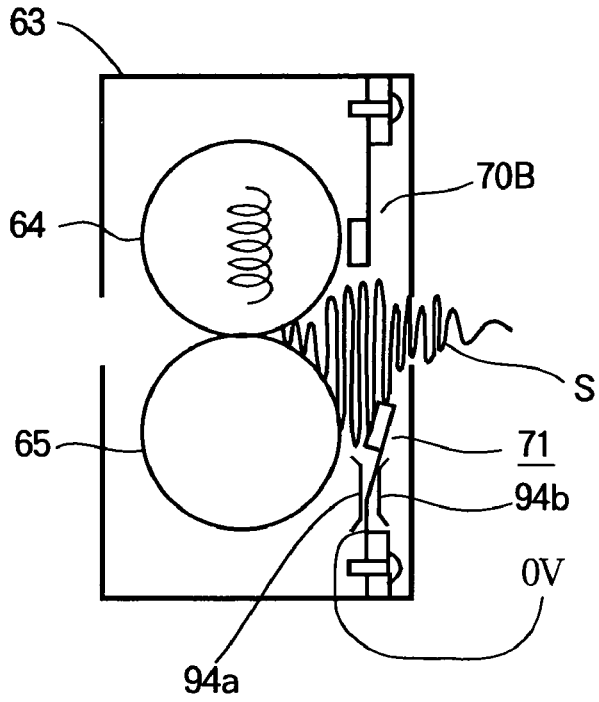
FIG. 32 illustrates the fixing unit according to the eighth embodiment when paper jam-like an accordion.

When paper jam like an accordion as shown in FIG. 32 occurs near an entrance of the fixing unit 63 during printing, the jammed paper S pushes the thermistor 71 and the base plate 76. This causes the temperature-sensing element 79 of the thermistor 71 to move out of contact with the pressure roller 65. Thus, the base plate 76 moves into contact with the conductor 94*b* in FIG. 31 to switch the switch 89 to the conductor 94*b*.

As described above, when the input voltage to the A/D converter 69 changes, the controller determines that the temperature-sensing element 79 of the thermistor 71 has moved out of contact with the pressure roller 65, and generates an alarm signal.

Figure 33:
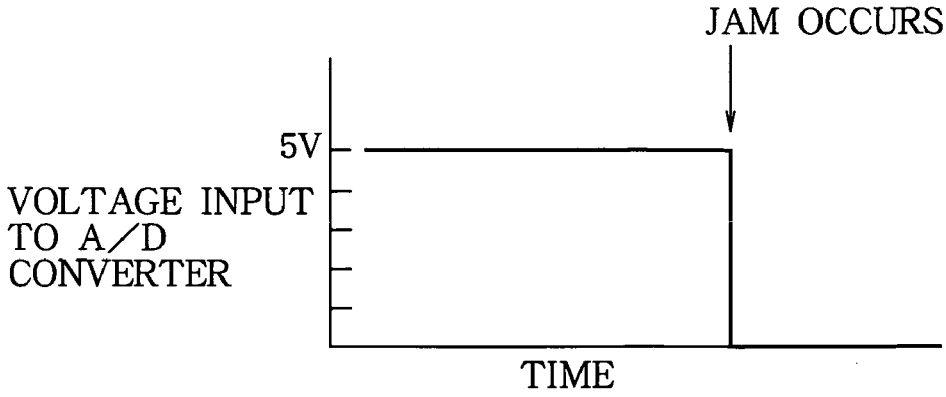
FIG. 33 illustrates analog voltage waveforms according to the eighth embodiment before and after the occurrence of paper jam.

FIG. 33 illustrates analog voltage waveforms before and after the occurrence of paper jam. When no paper jam occurs, the voltage at the input port of the controller is at an "H" level, which is substantially the same as 5-V supply voltage for the controller. When paper jam occurs, the voltage at the input of the A/D converter 69 in the controller is at an "L" level, which is 0 V. When paper jam occurs, the voltage at the input of the A/D converter 69 does not reflect the correct surface temperature of the pressure roller 65.

Once paper jam occurs, the operation of the fixing unit 63 will not be performed any further unless the jammed paper is removed and the thermistor 71 returns to its normal position. When the base plate of the thermistor 71 has deformed permanently, even though the jammed paper S is removed, the detection signal of the controller or the A/D converter 69 continues to indicate that temperature-sensing element 79 is out of contact with the pressure roller 65. Thus, the operation of the fixing unit 63 will not be performed any further.

Ninth Embodiment

Figure 34:
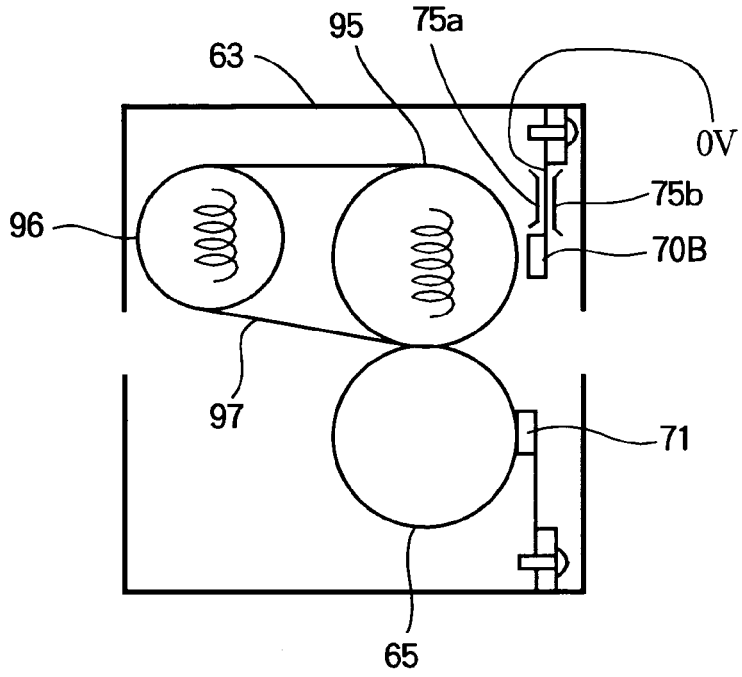
FIG. 34 illustrates the configuration of a ninth embodiment.
Figure 35:
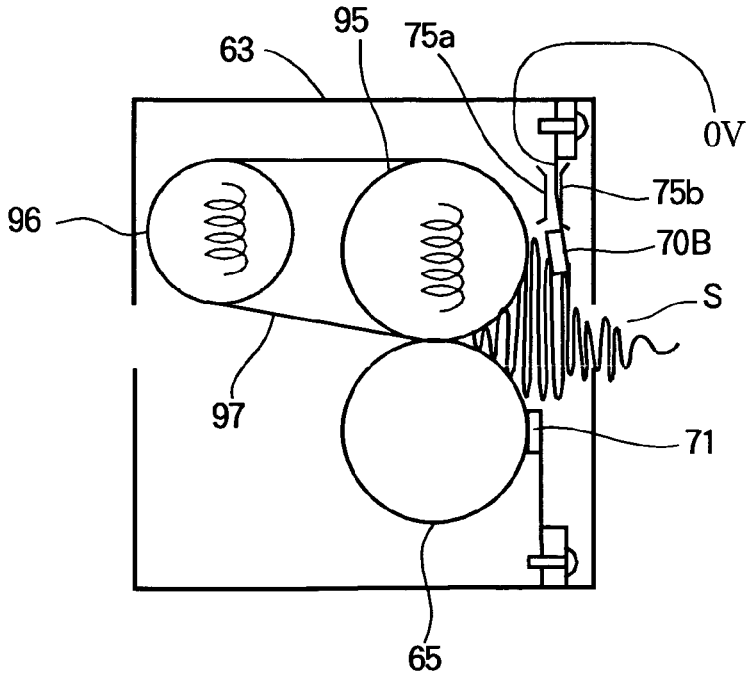
FIG. 35 illustrates the fixing unit according to the ninth embodiment when paper jam like an accordion.

FIGS. 34 and 35 illustrate the configuration of a ninth embodiment. The ninth embodiment differs from the conventional art in that a base plate 76 that supports a non-contact type thermistor 70B is positioned midway between conductors 75*a* and 75*b*. The base plate 76 is made of a resilient material.

The ninth embodiment may employ either of the type in FIG. 1A and the type in FIG. 1B. Here, the ninth embodiment will be described with respect to a case in which the thermistor of the type in FIG. 1B is used. The thermistor of FIG. 1B includes two signal lines isolated by an insulator 78 from the electrically conductive base plate 76 that supports a temperature-sensing element 79. The base plate 76 is connected to a potential of 0 V.

When no paper jam occurs, the base plate 76 is midway between the conductors 75*a* and 75*b* as shown in FIG. 34 such that the base plate 76 is not in contact with the conductors 75*a* and 75*b*. When paper jam occurs, the base plate 76 moves into contact with, for example, the conductor 75*b* as shown in FIG. 35.

With respect to a case where the thermistor 70B illustrated in FIG. 1B is used, a description will be given of the operation of detecting that the thermistor 70B has moved out of contact with a fixing belt 97 that serves as a heating belt.

When paper jam like an accordion as shown in FIG. 35 occurs near an entrance of the fixing unit 63 during printing, the jammed paper S pushes the thermistor 70B and the base plate 76. This causes the temperature-sensing element 79 of the thermistor 70B to move out of contact with the fixing belt 97. The base plate 76 moves into contact with either the conductor 75*a* or the conductor 75*b*.

Figure 36:
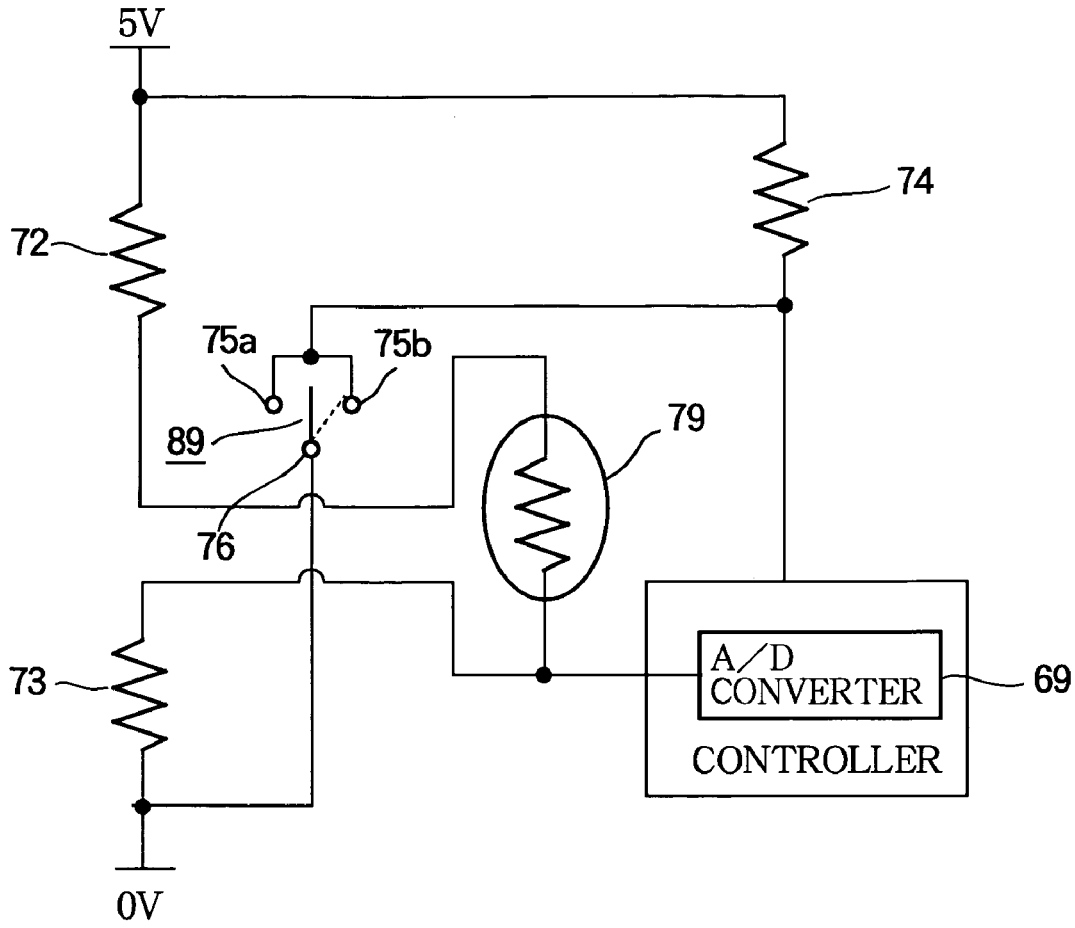
FIG. 36 is an electrically equivalent circuit of the ninth embodiment.

FIG. 36 is an electrically equivalent circuit including the voltage-dividing resistors 72 and 73, temperature-sensing element 79, conductors 75*a* and 75*b*, base plate 76, and resistor 74. A switch 89 represents the contacts between the base plate 76 and the conductors 75*a* and 75*b*. The resistor 74 has one end connected to a 5-V power supply and another end connected to the input port of the controller. When no paper jam occurs, the common electrode of the switch 89 is positioned midway between the conductors 75*a* and 75*b*. Therefore, the switch 89 is open, so that an "H" level appears at the input of the controller. When paper jam occurs, the base plate 76 of the thermistor 70B moves into electrical contact with, for example, the conductor 75*b*.

The operation of detecting will be described in which the non-contact type thermistor 71 has moved out of contact with a pressure roller 65 by a predetermined distance.

When paper jam like an accordion as shown in FIG. 35 occurs near an entrance of the fixing unit 63 during printing, the jammed paper S pushes the thermistor 70B and the base plate 76, so that the thermistor 70B moves out of contact with the pressure roller 65. The base plate 76 moves into contact with the conductor 75*b*.

As described above, when the input to the A/D converter 69 of the controller changes, the controller detects that the thermistor 70B has moved out of contact with the fixing belt 97, and generates an alarm signal.

Figure 37:
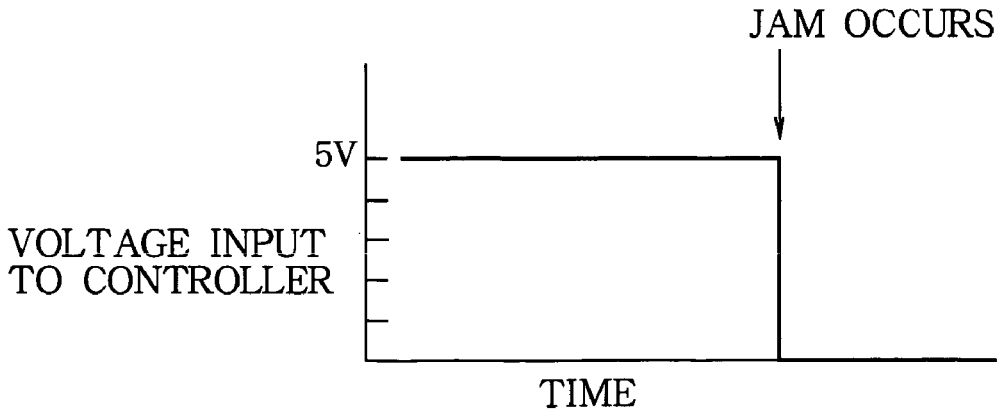
FIG. 37 illustrates analog voltage waveforms in the ninth embodiment before and after the occurrence of paper jam.

FIG. 37 illustrates analog voltage waveforms before and after the occurrence of paper jam. The controller detects these waveforms. When no paper jam occurs, the voltage at the input of the A/D converter 69 in the controller is at an "H" level, which is substantially the same as 5-V supply voltage for the controller. When paper jam occurs, the voltage at the input pot of the A/D converter 69 in the controller is at an "L" level, which is 0 V. The voltage at the input of the A/D converter 69 reflects the correct surface temperature of the fixing belt 97 regardless of whether paper jam occurs.

Once paper jam occurs, the operation of the fixing unit 63 will not be performed any further unless the jammed paper S is removed and the thermistor 70B returns to its normal position. If the base plate of the thermistor 70B has deformed permanently, the detection signals of the controller or the A/D converter 69 continues to indicate that the thermistor 70B is out of contact with the fixing belt 97 even though the jammed paper is removed. Thus, the operation of the fixing unit 63 will not be performed any further. The ninth embodiment has been described with respect to the non-contact type thermistor. The embodiment may also be implemented by the use of a contact type thermistor.

Although the present invention has been described with respect to a color printer, the invention may be applied to other apparatus provided that a developer image is fused by heat into a permanent image. While most of the embodiments have been described with respect to a contact type thermistor, the constructions of these embodiments may be used in combination with a non-contact type thermistor instead of a non-contact type thermistor. Although the embodiments have been described with respect to a case in which a thermistor is normally in contact with the fixing roller (i.e., heat roller), the thermistor may also be provided in contact with the pressure roller.

What is claimed is:

1. An image forming apparatus including a fixing member that heats a developer transferred onto a print medium to fix the developer, the image forming apparatus comprising:

a temperature detector having a temperature detecting element that detects a temperature of a fixing member; and a movement detector that detects a position of the temperature detecting element.

2. An image forming apparatus having a fixing unit that fixes a developer transferred onto a print medium, the apparatus comprising:

a temperature detector having a temperature detecting element that detects a temperature of a fixing member located in the fixing unit; and a movement detector that detects that said temperature detecting element has moved relative to the fixing member.

3. The image forming apparatus according to claim 2, wherein the fixing member is a fixing roller.

4. The image forming apparatus according to claim 3, wherein the fixing roller is a heat roller that is heated by a heat source.

5. The image forming apparatus according to claim 3, wherein the fixing roller is a pressure roller that is in pressure contact with the heat roller.

6. The image forming apparatus according to claim 2, wherein the fixing member is a fixing belt.

7. The image forming apparatus according to claim 6, wherein the fixing belt is a heating belt that is heated by a heat source.

8. The image forming apparatus according to claim 2, wherein said movement detector includes a first electrically conductive member and a second electrically conductive member connected to each other via the temperature detecting element and a third electrically conductive member disposed in the vicinity of the temperature detecting element, wherein when the temperature detecting element moves, either the first electrically conductive member or the second electrically conductive member establishes electrical continuity with the third electrically conductive member.

9. The image forming apparatus according to claim 2, wherein said movement detector includes a first electrically conductive member mounted to the temperature detecting element, a second electrically conductive member disposed in the vicinity of the temperature detecting element, wherein when the temperature detecting element moves, the first electrically conductive member and the second electrically conductive member establish electrical continuity with each other.

10. The image forming apparatus according to claim 2, wherein said movement detector includes a first electrically conductive member and a second electrically conductive member connected to each other via the temperature detecting element;

wherein when the temperature detecting element moves, the first electrically conductive member and the second electrically conductive member establish electrical continuity with each other.

11. The image forming apparatus according to claim 10, wherein the first electrically conductive member has a first end and a second end and the second electrically conductive member has a third end and a fourth end, the first electrically conductive member and the second electrically conductive member being electrically connected to the temperature detecting element through the first end and third end, the second end and the fourth end being connected to a stationary portion of the fixing unit.

12. The image forming apparatus according to claim 2, wherein the movement detector includes a first electrically conductive member and a second electrically conductive member connected to each other via the temperature detecting element, and a third electrically conductive member disposed in proximity to the temperature detecting element;

wherein when the movement detector moves, the first electrically conductive member and the second electrically conductive member establish electrically continuity through the third electrically conductive member.

13. The image forming apparatus according to claim 10, wherein the first electrically conductive member has a projection in proximity to the second electrically conductive member;

wherein when the temperature detecting element moves, the projection establishes electrical continuity with the second electrically conductive member.

14. The image forming apparatus according to claim 2, wherein the temperature detecting element outputs an electrical signal indicative of the temperature of the fixing member, and said temperature detector includes an electrical signal detecting section that detects the electrical signal;

wherein the movement detector determines based on the electrical signal detected by the electrical signal detecting section that the temperature detecting element has moved.

15. The image forming apparatus according to claim 2, wherein the movement detector includes an electrical switch disposed in proximity to the temperature detecting element;

wherein when the temperature detecting element moves, the switch either opens or closes.

16. The image forming apparatus according to claim 2, wherein the temperature detecting element is mounted to a resilient member.

17. The image forming apparatus according to claim 2, wherein the temperature detecting element is disposed in contact with the fixing member and said movement detector detects that the temperature detecting element has moved out of contact with the fixing member.

18. The image forming apparatus according to claim 2, wherein the temperature detecting element is disposed in proximity to the fixing member, and the movement detector detects that the temperature detecting element has moved relative to the fixing member.

19. The image forming apparatus according to claim 2, wherein said movement detector includes a first electrically conductive member, a second electrically conductive member connected to each other via the temperature detecting element, and a third electrically conductive member;

wherein when no paper jam occurs, the first electrically conductive member remains in electrical contact with the third electrically conductive member;

wherein when paper jam occurs, the first electrically conductive member moves out of contact with the third electrically conductive member.

* * * * *